US007108196B2

(12) United States Patent
Kime

(10) Patent No.: US 7,108,196 B2
(45) Date of Patent: Sep. 19, 2006

(54) METHOD AND APPARATUS FOR DEPOSITING SNOW-ICE TREATMENT LIQUID ON PAVEMENT

(76) Inventor: James A. Kime, 3987 Riverview Dr., Columbus, OH (US) 43221

( * ) Notice: Subject to any disclaimer, the term of this patent is extended or adjusted under 35 U.S.C. 154(b) by 223 days.

(21) Appl. No.: 10/787,519

(22) Filed: Feb. 26, 2004

(65) Prior Publication Data

US 2005/0189432 A1 Sep. 1, 2005

(51) Int. Cl.
*A01G 25/09* (2006.01)
*B05B 1/20* (2006.01)

(52) U.S. Cl. ..... 239/1; 239/67; 239/69; 239/155; 239/159; 239/164; 239/170; 239/172; 239/536; 239/550; 239/551; 37/227

(58) Field of Classification Search ..... 239/1, 239/67, 69, 155, 159, 164, 170, 172, 156, 239/160–163, 165–169, 536, 550, 551; 37/227, 37/228

See application file for complete search history.

(56) References Cited

U.S. PATENT DOCUMENTS 3,456,368 A * 7/1969 Jacques ..... 37/228
4,052,003 A * 10/1977 Steffen ..... 239/155
4,161,280 A * 7/1979 Kasinskas ..... 239/1
4,271,617 A * 6/1981 Yoshizawa ..... 239/754
5,515,623 A * 5/1996 Weeks ..... 37/227
5,911,363 A * 6/1999 Oligschlaeger ..... 239/155
5,964,410 A * 10/1999 Brown et al. ..... 239/159
6,454,183 B1 * 9/2002 Hedegaard ..... 239/172
6,702,200 B1 * 3/2004 Solie et al. ..... 239/172
6,749,128 B1 * 6/2004 Oosterman ..... 239/170

* cited by examiner

*Primary Examiner*—Steven J. Ganey
(74) *Attorney, Agent, or Firm*—Mueller and Smith, LPA

(57) ABSTRACT

Method and apparatus for depositing liquid brine on roadway surface. Substantially horizontally disposed streamer nozzles are employed in conjunction with brine pumps which are operated in correspondence with the forward speed of the treatment vehicle. Substantially horizontally disposed streamer nozzles express the fluid at a rate corresponding with the vehicle forward velocity to effect a relative zero velocity relationship between the pavement and liquid. These streamer nozzles are mounted close to the pavement surface at a location effective to avoid truck induced air turbulence.

44 Claims, 11 Drawing Sheets

POWER UP
320
322
INITIALIZATION
324
326
ENTER MAIN LOOP
328
368
330
MODULE SELECT
332
334
336
CONFIGURATION
338
DATA LOG
340
COMMUNICATIONS
342
PRESSURE READINGS
344
FLUID TEMP
346
FAULT HANDLING
348
PLOW HANDLING
350
BED CONTROL
352
SPEED
356
SPINNER
358
WETTER
360
AUGER
EJECTOR
354
362
USER INTERFACE (DISPLAY) (CALIBRATION)
364
RETURN
366
368

METHOD AND APPARATUS FOR DEPOSITING SNOW-ICE TREATMENT LIQUID ON PAVEMENT

CROSS-REFERENCE TO RELATED APPLICATIONS

STATEMENT REGARDING FEDERALLY SPONSORED RESEARCH

Not applicable.

BACKGROUND OF THE INVENTION

Roadway snow and ice control typically is carried out by governmental authorities with the use of dump trucks which are seasonally modified by the addition of snow-ice treatment components. These components will include the forwardly-mounted plows and rearwardly-mounted mechanisms for broadcasting materials such as salt or salt-aggregate mixtures. The classic configuration for the latter broadcasting mechanisms included a feed auger extending along the back edge of the dump bed of the truck. This hydraulically driven auger effects a metered movement of material from the bed of the truck onto a rotating spreader disk or "spinner" which functions to broadcast the salt across the pavement being treated. To maneuver the salt-based material into the auger, the dump bed of the truck is progressively elevated as the truck moves along the roadway to be treated. Thus, when into a given run, the dump bed will be elevated, dangerously raising the center of gravity of the truck under inclement driving conditions.

An initial improvement in the controlled deposition of salt materials and the like has been achieved through the utilization of microprocessor driven controls over the hydraulics employed with the seasonally modified dump trucks. See Kime, et al., U.S. Pat. No. Re33,835, entitled "Hydraulic System for Use with Snow-Ice Removal Vehicles", reissued Mar. 3, 1992. This Kime, et al. patent describes a microprocessor-driven hydraulic system for such trucks with a provision for digital hydraulic valving control which is responsive to the instantaneous speed of the truck. With the hydraulic system, improved controls over the extent of deposition of snow-ice materials is achieved. This patent is expressly incorporated herein by reference.

Investigations into techniques for controlling snow-ice pavement envelopment have recognized the importance of salt in the form of salt brine in breaking the bond between ice and the underlying pavement. Without a disruption of that bond, little improvement to roadway traction will be achieved. For example, the plow merely will scrape off the snow and ice to the extent possible, only to leave a slippery coating which may be more dangerous to the motorist than the pre-plowed road condition.

When salt has been simply broadcast over an ice laden pavement from a typical spinner, it will have failed to form a brine of sufficient salt concentration to break the ice-pavement bond. The result usually is an ice coated pavement, in turn, coated with a highly dilute brine solution developed by too little salt, which will have melted an insufficient amount of ice for traction purposes. This condition is encountered often where granular salt material contains a substantial amount of "fines". Fines are very small salt particles typically generated in the course of transporting, stacking, and storing road maintenance salt in dome-shaped warehouses and the like.

Road snow-ice control studies have revealed that the activity of ice melting serving to break the noted ice-pavement bond is one of creating a saltwater brine of adequate concentration. In general, an adequate salt concentration using conventional dispersion methods requires the distribution of unacceptable quantities of salt on the pavement. Some investigators have employed a saturated brine as the normal treatment modality by simply pouring it on the ice covered roadway surface from a lateral nozzle-containing spray bar mounted behind a truck. A result has been that the thus-deposited brine concentration essentially immediately dilutes to ineffectiveness at the ice surface, with a resultant dangerous liquid-coated ice roadway condition.

Attempting to remove ice from pavement by dissolving the entire amount present over the entire expanse of pavement to be treated is considered not to be acceptable from an economical standpoint. For example, a one mile, 12 foot wide roadway lane with a ¼ inch thickness of ice over it should require approximately four tons of salt material to make a 10% brine solution and create bare pavement at 20° F. Technical considerations for developing a salt brine effective to achieve adequate ice control are described, for example, by D. W. Kaufman in "Sodium Chloride: The Production and Properties of Salt and Brine", Monograph Series 145 (Amer. Chem. Soc. 1960).

The spreading of a combination of liquid salt brine and granular salt has been considered beneficial. In this regard, the granular salt may function to maintain a desired concentration of brine for attacking the ice-pavement bond and salt fines are more controlled by dissolution in the mix. The problem of excessive salt requirements remains, however, as well as difficulties in mixing a highly corrosive brine with particulate salt. Typically, nozzle injection of the brine is the procedure employed. However, attempts have been made to achieve the mix by resorting to the simple expedient of adding concentrated brine over the salt load in a dump bed. This approach is effective to an extent. However, as the brine passes through the granular salt material, it dissolves the granular salt such that the salt will not remain in solution and will recrystallize, causing bridging phenomena and the like inhibiting its movement into a distribution auger.

The problem of the technique of deposition of salt in a properly distributed manner upon the roadway surface also has been the subject of investigation. Particularly where bare pavement initially is encountered, snow/ice materials utilized in conventional equipment will remain on the roadway surface at the time of deposition only where the depositing vehicles are traveling at dangerously slow speeds, for example about 15 mph. Above those slow speeds, the material essentially is lost to the roadside. Observation of materials attempted to be deposited at higher speeds shows the granular material bouncing forwardly, upwardly, and being broadcast over the pavement sides such that deposition at higher speeds is ineffective as well as dangerous and potentially damaging to approaching vehicles. That latter damage sometimes is referred to as "collateral damage" or damage to coincident traffic. However, the broadcasting trucks themselves constitute a serious hazard when traveling, for example at 15 mph, particularly on dry pavement, which simultaneously is accommodating vehicles traveling, for example at 65 mph. The danger so posed has been considered to preclude the highly desirable procedure of depositing the salt material on dry pavement just before the onslaught of snow/ice conditions. Of course, operating at such higher speeds with elevated dump truck beds also poses a hazardous situation.

Kime, et al., in U.S. Pat. No. 5,318,226 entitled "Deposition of Snow-Ice Treatment Material from a Vehicle with Controlled Scatter", issued Jun. 7, 1994, (incorporated herein by reference) describes an effective technique and mechanism for controlling the scatter of the so-called granules at higher speeds. With the method, the salt materials are propelled by an impeller from the treatment vehicle at a velocity commensurate with that of the vehicle itself and in a direction opposite that of the vehicle line of travel. The result is an effective suspension of the projected materials over the surface of pavement under a condition of substantially zero velocity with respect to or relative to the surface of deposition. Depending upon vehicle speeds desired, material deposition may be provided in controlled widths ranging from narrow to wider bands to achieve a control over material placement. See also, U.S. Pat. Nos. 5,842,649 and 5,947,391 by Beck et al.

A practical technique for generating a brine of sufficient concentration to break the ice-pavement bond is described in U.S. Pat. No. 5,988,535 entitled "Method and Apparatus for Depositing Snow-Ice Treatment Material on Pavement", by Kime, issued Nov. 23, 1999 and incorporated herein by reference. With this technique, ejectors are employed to deposit a salt-brine mixture upon a roadway as a relatively narrow, continuous and compact band of material. To achieve such narrow band material deposition at practical roadway speeds of 40 mph or more, the salt-brine mixture is propelled from the treatment vehicle at a velocity commensurate with that of the vehicle itself and in a direction opposite that of the vehicle. Further, the material is downwardly directed at an acute angle with respect to the plane defined by the pavement. When the salt-brine narrow band is deposited at the superelevated side of a roadway lane, the resultant concentrated brine from the band is observed to gravitationally migrate toward the opposite or downhill side of the treated lane to provide expanded ice clearance. The result is a highly effective snow-ice treatment procedure with an efficient utilization of salt materials. Because the lanes of modern roadways are superelevated in both a right and a left sense, two spaced apart salt ejectors are employed to deposit the narrow band concentration at positions corresponding with the tire tracks of vehicles located at the higher or elevated portion of a pavement lane. A feature of the apparatus of this system is its capability for being mounted and demounted upon the dump bed of a conventional roadway maintenance truck in a relatively short interval of time. As a consequence, these dump trucks are readily available for carrying out tasks not involving snow-ice control. Additionally, the apparatus is configured such that the dump beds remain in a lowered or down position throughout their use, thus improving the safety aspect of their employment during inclement winter weather.

In addition to the hazards posed by slow speeds of travel, trucks utilized for snow-ice treatment exhibit difficulties negotiating ice coated roadways, particularly where uphill grades are encountered. One technique for driving upon such ice coated hills has been to turn the trucks around, activate the rear mounted salt broadcasting spinner and travel up the incline in reverse gear. This procedure achieves only marginal traction and is manifestly an undesirable solution to this traction problem.

An improvement in zero relative velocity broadcasting technique is described in U.S. Pat. No. 6,446,879, entitled "Method and Apparatus for Depositing Snow-Ice Treatment Material on Pavement" by Kime, issued Sep. 10, 2002, in which narrow band ejection of salt and brine is provided in a manner wherein it is encountered by the rear drive wheels of a dump truck. For both approaches of the above-described narrow band deposition, the dump truck structuring is such that use may be made of them for purposes other than snow-ice control during winter seasons. In this regard, roadway maintenance organizations require that the dump trucks be capable of being used for such purposes as hauling gravel and/or pothole repair materials.

Over the recent past, investigators have returned to the subject of pre-treating a bare or dry roadway pavement before a weather event occurs otherwise generating ice/pavement bond conditions. Rather than attempting to deposit granular salt on a roadway, brine is placed on the roadway in small, angularly downwardly directed streams spaced about eight to twelve inches apart and usually extending across a width of one driving lane. The total application rate usually is thirty to sixty gallons of salt brine per lane mile. Where clear weather permits, the resultant brine strips will dry leaving a tenaciously bonded strip of fine salt along the pavement somewhat emulating paint. With continued dry weather, these fine crystalline strips will remain on the pavement for several days or more except for some deterioration along tire track regions. When snow conditions then commence, the resultant moisture will activate the strips to attack the very development of an ice/pavement bond condition. Rubber edged squeegee plows have been used to remove a resulting un-bonded slush from the pretreated roadway. Some governmental roadway organizations consider a multi-nozzle broad deposition of brine also to be beneficial in the de-icing treatment of roadways which are frosted or carrying low water content "black ice".

The excellent effectiveness and attendant environmental and economic advantages of brine treatment programs is significant. In general, governmental roadway organizations consider that an initial application upon roadways under snow/ice conditions for example, on interstate roadways will be about six hundred pounds of granular salt per mile. A pretreatment of liquid brine, for example, at about sixty gallons per mile will invoke the use of a corresponding amount of salt from between about 100 and 125 pounds. Of particular interest, because the brine can be deposited well before an impending weather event, trucks and drivers can be utilized during normal working hours. In compliment with these economies, improvements have been made in the techniques employed for forming the brine solutions prior to loading on the depositing trucks. See, for example, U.S. Pat. No. 6,736,153 by Kime, entitled "Brining System, Method and Apparatus" issued May 18, 2004.

Notwithstanding the excellent physical results achieved with pre-treatment or "anti-icing" roadway brining, the problems associated with deposition on high speed interstate roadway systems have continued. When the brine is applied from downwardly angulated spray bars at the rear of trucks at speeds above about thirty miles per hour, significant amounts of the brine are lost, due, for example, to turbulence behind the application truck. At more desirable speeds of about fifty miles per hour it is estimated that about fifty percent or more of the brine is lost to turbulence. Compounding this deposition problem is the generation of turbulence derived brine overspray, splashed or mist which will extend about one hundred feet behind a truck traveling at about fifty miles per hour. Coincident traffic, attempting to maintain roadway speeds will overtake and attempt to pass the treatment trucks at their peril. Coincident traffic drivers have experience windshield blockage based blindness due to the brine mist for alarming intervals of time occurring before windshield wiper activation and clearance can be accomplished.

BRIEF SUMMARY OF THE INVENTION

The present invention is addressed to apparatus and method for treating a roadway or roadway by accurately depositing a volumetric quantity of snow-ice treatment liquid onto its surface with minimization of splash and overspray phenomena. With the method, the treatment liquid is expressed rearwardly from one or more streamer nozzles in correspondence with the forward velocity of the treatment vehicle. This control arrangement effects a substantially zero relative velocity between the expressed volume of liquid and the treated pavement surface. Disruption of the rearwardly expressed liquid by vehicle created air turbulence is minimized by aligning the axis of each streamer nozzle to be substantially in parallel relationship with the pavement surface as well as vehicle direction of movement and locating each nozzle in spaced adjacency with the pavement surface, for instance, about six inches or less. Such closely adjacent spacing further will take advantage of any surface effect between the expressed liquid volume and the pavement surface.

The accuracy of deposition of target liquid volumes per unit roadway distance is enhanced through the utilization of controlled fixed displacement pumps in conjunction with computed streamer nozzle effective diameters.

In a preferred embodiment particularly suited for pretreating dry pavement prior to a weather event, three streamer nozzles are utilized including a left nozzle mounted laterally outwardly from the treatment vehicles' left wheel assembly; a right nozzle mounted laterally outwardly from the treatment vehicles' right wheel assembly and an intermediate nozzle located between the left and right wheel assemblies. One of the left or right nozzles is operator activated to deposit treatment liquid at the higher elevation or crown region of a roadway lane, while the intermediate nozzle is utilized in concert with the elected right or left nozzle. With this arrangement, the pretreatment liquid is deposited at regions which are not located within the wheel tracks of normal coincident traffic. Thus, the treatment liquid may dry upon the pavement without disruption from such coincident vehicular traffic. On the occasion of a weather event, the liquid weather precipitation then reconstitutes the deposited and dried brine as a liquid which then migrates, as it were, downhill into the wheel tracks of vehicular traffic to prevent the formation of a snow-ice-pavement bond. Such pretreatment substantially facilitates subsequent plow based removal of snow and ice.

In an alternate embodiment an array of, for example, eight streamer nozzles is deployed in regularly spaced relationship across the width of the treatment vehicle. The arrayed nozzles are supplied treatment liquid from a manifold which in turn, is supplied with an accurately pumped amount of liquid utilizing one or more of the same pump assemblies employed with the preferred embodiment. Election valving may be adjusted by the vehicle operator to select one or the other of the embodiments.

Other objects of the invention will, in part, be obvious and will, in part, appear hereinafter. The invention, accordingly, comprises the apparatus and method possessing the construction, combination of elements, arrangement of parts and steps which are exemplified in the following description.

For a fuller understanding of the nature and objects of the invention, reference should be made to the following detailed description taken in connection with the accompanying drawings.

DETAILED DESCRIPTION OF THE INVENTION

In the discourse to follow two, alternate approaches for accurately dispensing snow-ice control liquid at high speeds on primary roadway pavement are disclosed. It may be recalled that for pretreatment or anti-icing procedures, this deposition of the snow-ice control liquid is made on dry pavement before precipitation weather occurs. With each approach, the liquid brine is expressed from one or more streamer nozzles, the axes of which are substantially parallel to the roadway surface, at a volumetric flow rate which corresponds with the forward velocity of the dispensing vehicle. Thus, a substantially zero relative velocity is extant between what may be considered a horizontal column of liquid and the roadway surface. These streamer nozzles also are mounted such that they are in a relatively close spaced adjacency with the roadway surface such that the liquid stream being ejected tends to avoid air turbulence caused by the traveling dispensing vehicle and takes advantage of any surface effect available with the surface of the roadway pavement. In a preferred approach, leftward, rightward and a central nozzle are employed. Of these, the leftward nozzle is located outboard of the left wheel assembly of the vehicle and the rightward nozzle is mounted outboard of the rightward wheel assembly. The central nozzle is located intermediate the wheel assemblies. As a consequence, the brine is laid down beyond the wheel tracks of coincident roadway traffic. Rightward and leftward streamer nozzles are utilized inasmuch as primary roadways incorporate multiple lane designs and the location of superelevations or crowns must be accommodated for.

In an alternate application approach an array of nozzles is mounted rearwardly of the dispensing vehicle such that essentially the entire lane of roadway is coated with the snow-ice control solution at some target volume per unit length of roadway. Deposition again is carried out with streamer nozzles having nozzle axes which are substantially parallel with the surface of the roadway being treated and liquid ejection is at a speed corresponding with the instantaneous forward vehicle speed to permit derivation of zero liquid/roadway relative velocities.

Figure 1:
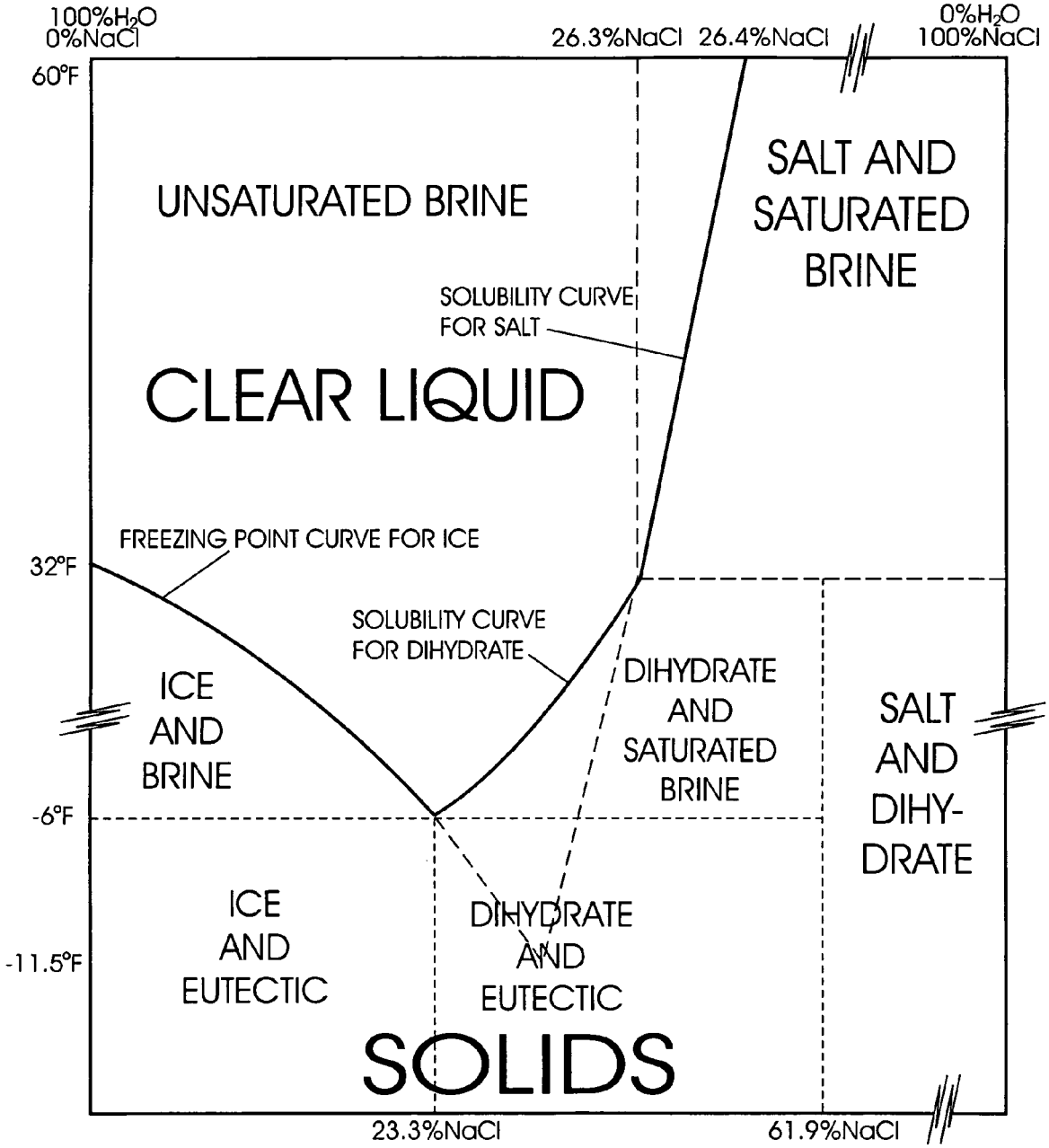
FIG. 1 is a sodium chloride/water phase chart.

The snow-ice control liquid utilized for these applications is premixed preferably as a high sodium chloride content saturated brine. Looking momentarily to FIG. 1, a phase chart for such liquid is revealed. In the figure, the concentration of sodium chloride with water is shown as an abscissa extending between zero percent NACL and 100% NACL. Correspondingly, the ordinate shows temperatures extending from 60° F. and below. An eutectic mixture or lowest freezing point for the brine is seen to be at about −6° F. While small ice crystals may form in that temperature region, the positive displacement pumps employed with the apparatus and technique have no difficulty in carrying out their intended function. In general, for example, in the Midwestern regions of the United States, weather events which involve precipitation will occur at temperatures above about 20° F. Below that level, the weather tends to remain clear without precipitation.

Figure 2:
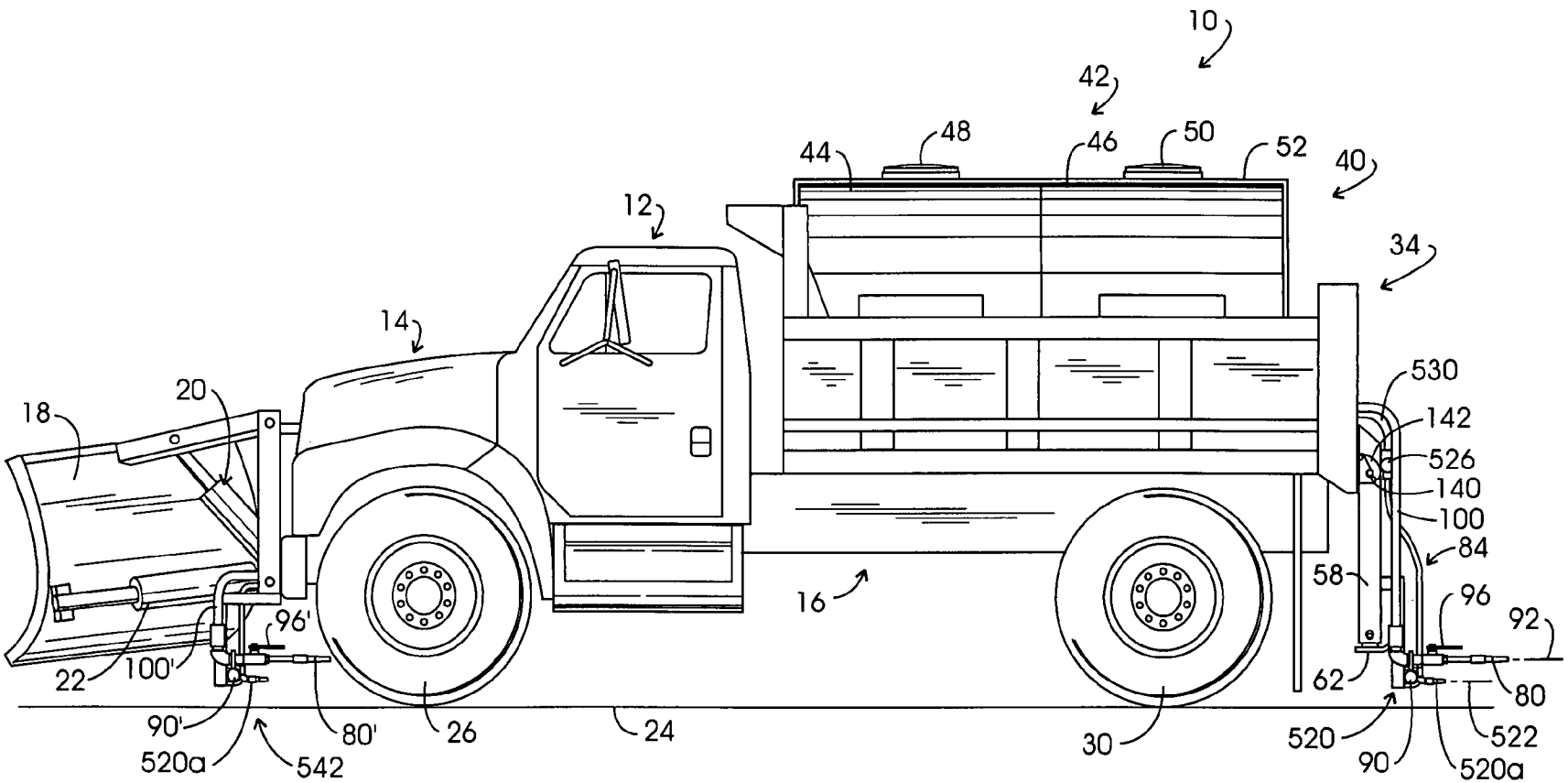
FIG. 2 is a left side elevational view of a truck outfitted with apparatus according to the invention.

Referring to FIG. 2, a utility vehicle which may be employed with the seasonal duties of snow/ice removal as well as other truck-based endeavors not related to snow/ice control is revealed generally at 10. Configured as a dump truck, vehicle 10 includes a cab 12 and hood 14 which protects and provides access to an engine (not shown). These components are mounted upon a frame represented generally at 16. At the forward end of the vehicle 10 there is mounted a front snow plow 18 which is elevationally maneuvered by up-down hydraulic cylinder assembly 20. Additionally, front plow 18 is laterally, angularly adjusted by left-side and right-side single acting hydraulic cylinder assemblies, the left-side one of which is represented at 22. Not shown in the figure, is a wing plow which is mounted adjacent the right or left fender of vehicle 10 and which functions generally as an extension of the front plow 18, serving to push snow off a shoulder. Additionally not shown are scrapper plows which are mounted beneath the frame 16 and which are hydraulically controlled. Front plow 18, for utilization in conjunction with pretreatment brining also may be configured as a "squeegee" plow, the lower portion of which is configured with a rubber compound. A squeegee-type plow may be employed following brine pretreatment procedures inasmuch as the snow/ice pavement bond will have been defeated at the onset of weather event precipitation.

Truck 10 is supported on the roadway pavement surface 24 by leftward and rightward pavement engaging wheels. Shown in the figure is left front wheel 26 and left rear dual wheels 30. Frame 16 provides a support portion represented generally at 34 implemented as a hydraulically actuated dump bed with a bed surface (not shown).

Figure 3:
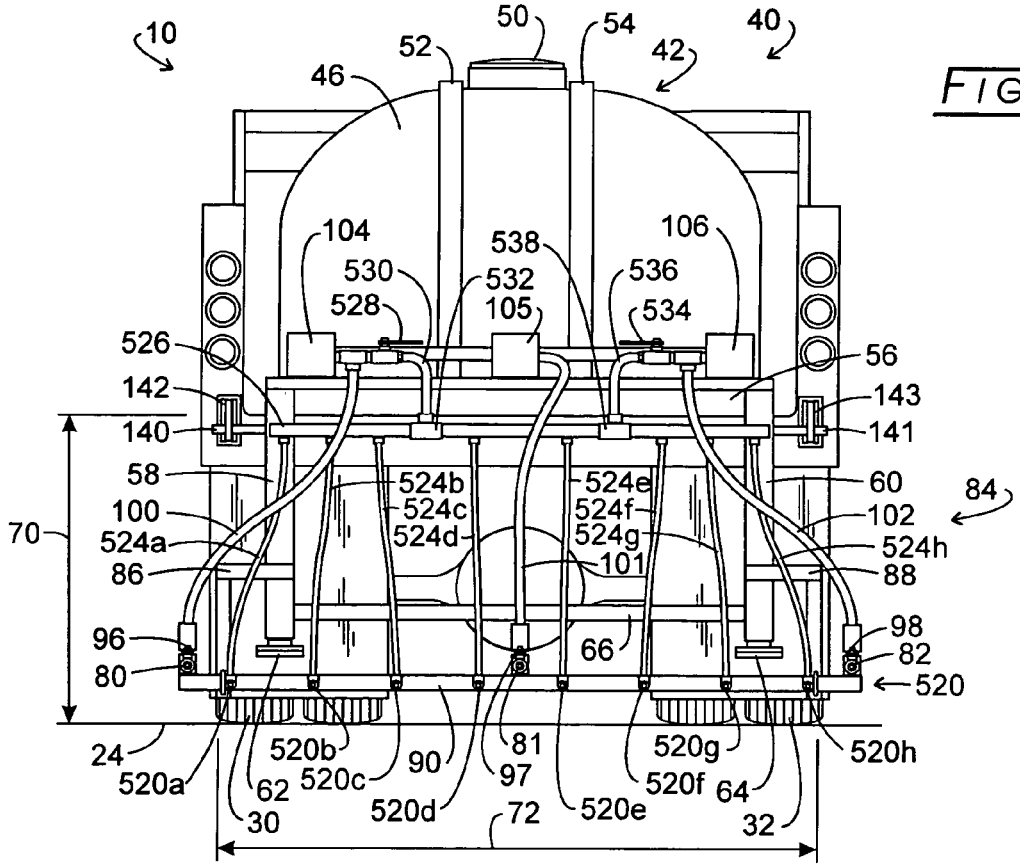
FIG. 3 is a rear view of the truck of FIG. 2.

Looking additionally to FIG. 3, dump bed or support portion 34 is shown carrying a frame-mounted modular snow/ice control apparatus represented generally at 40 which is configured for carrying out a pretreatment procedure by depositing a snow-ice treatment liquid such as a sodium chloride brine upon a dry pavement surface. Apparatus 40 includes a tank assembly represented generally at 42. Assembly 42 is shown comprised of two polymeric tanks 44 and 46 which are of generally elliptical cross-section at their center region with forwardly and rearwardly integrally formed support portions. Manways are shown respectively at 48 and 50 and the tanks are interconnected adjacent their bottom portions with one or more equalizing conduits, for example, having a diameter of about three inches. Such an equalization arrangement along with the design and a modular use of the tanks functions to avoid sloshing of the liquid within the tanks. Each of the tanks 44 and 46 may, for example, have a capacity of about 650 gallons and will be loaded with premixed brine. That brine may be premixed with the system described in the above-identified application for U.S. patent by Kime, Ser. No. 09/961,469. While the tanks may be mounted directly on the floor of dump bed 34, the apparatus 40 may be configured in modular fashion mounted upon a frame which is supported from the floor of the dump bed 34. In this regard, the figures reveal two galvanized brackets 52 and 54 which are components of that frame. FIG. 3 reveals a rearward cross beam 56 of the frame along with left and right rigid galvanized standards 58 and 60 having respective foot components 62 and 64 shown in their retracted orientations. A support 66 extends between standards 58 and 60. FIG. 3 reveals that the frame supporting the tanks and apparatus 40 will be at a bed height above pavement 24 represented by arrow 70 while the wheels as at 26, 30 and 32 define a wheel track during movement of vehicle 10. The figure reveals that the wheel tracks are spaced apart a vehicle track width defined at arrow 72.

Apparatus 40 is configured to combine each of the above-noted liquid distribution embodiments in conjunction with manually actuable election valving. The combined embodiments utilize common motor and pump components in combination with a processor-based control normally employed for salt distribution but adapted with a manual input logic to carry-out accurate fluid volume and nozzle-based distribution. FIG. 3 illustrates that the preferred embodiment includes a rearwardly directed left streamer nozzle 80; a rearwardly directed intermediate streamer nozzle 81; and a rearwardly directed right streamer nozzle 82. Nozzles 80–82 are supported upon a nozzle support represented generally at 84 and comprised of downwardly depending standards 58 and 60, galvanized brackets 86 and 88 and a lower disposed cross rod 90 which is positioned in spaced adjacency with pavement surface 24. Note that such spacing is quite close to the pavement. Rod 90 generally will be parallel with the pavement surface 24. Also, it may be observed that it extends leftwardly outwardly from the leftward wheel assembly 30 and, accordingly, leftwardly outwardly from the left vehicle wheel tracks within a given roadway lane. Left streamer nozzle 80 is mounted at the left end of rod 90 and thus is located about six inches laterally outwardly and leftwardly from the vehicle tracks represented by the wheel assembly 30. As shown in FIG. 2, the nozzle axis 92 of nozzle 80 is substantially parallel with the surface of pavement 24 and is arranged so as to be additionally parallel with the forward direction of travel of the vehicle 10. Experience with this form of mounting has shown that the nozzle axis as at 92 may be canted downwardly toward the pavement surface 24 by a shallow angle within a range of from about 0° to about 5°. Note that cross rod 90 also extends laterally rightwardly and outwardly from rear wheel assembly 32 and it's associated right wheel track. In similar fashion as left nozzle 80, right streamer nozzle 82 is rearwardly directed and it's nozzle axis (not shown) is substantially parallel with the surface of pavement 24 as well as the forward directional movement of truck 10. Right nozzle 82 is located about six inches laterally rightwardly outwardly from the outside of wheel assembly 32 or the right wheel track region. Intermediate nozzle 81 is mounted on top of cross rod 90 at a location between what will be right and left vehicle wheel tracks on a given roadway lane. The rearwardly directed streamer nozzle is configured with a nozzle axis (not shown) which is substantially parallel with the surface of pavement 24 such that its orientation is the same as nozzles 80 and 82. In general, nozzles 80–82 are mounted upon rod 90 with clamps such that they can be positionally adjusted. The close proximity of the axes of nozzles 80–82 to the roadway pavement surface 24 permits their expression of a volumetrically controlled stream of liquid from their tips at a location avoiding wind turbulence developed by the forward movement of vehicle 10. That volumetric rate of liquid expression is controlled such that, in effect, a theoretical cylinder of liquid is generally horizontally projected rearwardly at a flow velocity having a horizontal velocity vector corresponding with the forward velocity of vehicle 10. Accordingly, there will be no relative motion between the stream of liquid and the surface of pavement 24. The expressed streams of liquid drop to the pavement under the influence of gravity with very little overspray or splash. This close proximity of the streams of liquid to the pavement surface further takes advantage of any surface effect naturally lessening wind of movement in adjacency with the surface of pavement 24. The inputs of streamer nozzles 80–82 extend forwardly from respective hand actuated election ball valves 96–98. When those election ball valves are in an open orientation, the inputs of the nozzles are in fluid transfer communication via respective brine carrying hoses 100–102 with the pump outputs of three discrete combined motors and pumps represented at respective blocks 104–106.

Figure 4:
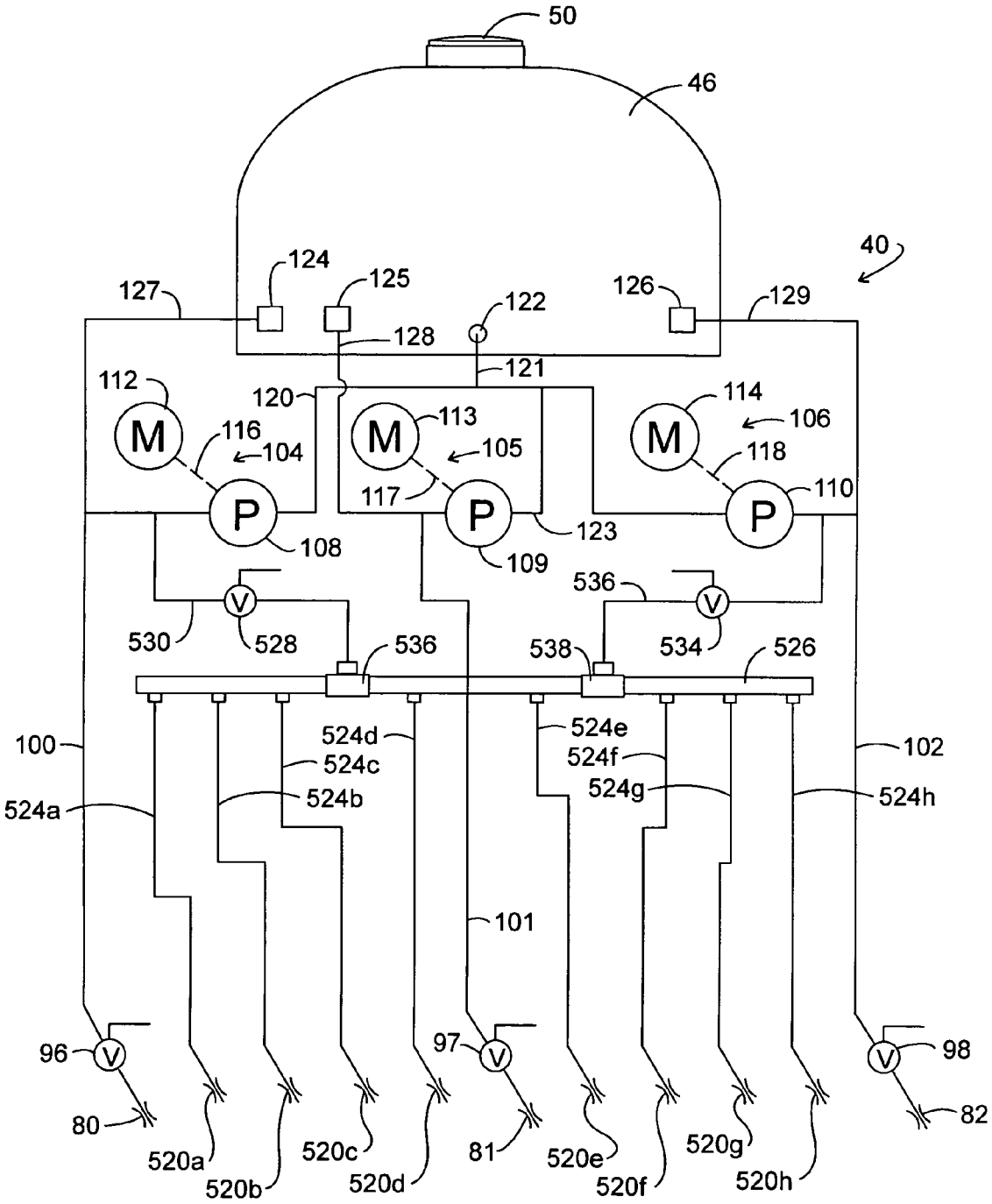
FIG. 4 is a schematic diagram illustrating the distribution of brine liquid utilizing a three streamer nozzle arrangement and an alternative streamer nozzle array arrangement.

Looking momentarily to FIG. 4, a fluid circuit diagram is schematically portrayed wherein streamer nozzles 80–82 are represented with the same numeration but in symbol form. Similarly, hand actuated election ball valves 96–98 are symbolically represented in conjunction with respective brine delivery hoses 100–102. Note that hose line 100 extends to the output of pump 108 of motor and pump assembly 104. That pump output is coupled in driven relationship with a motor 112 as represented by dashed line 116. In similar fashion, brine delivery hose 101 extending from intermediate nozzle 81 and valve 97 extends to the output of a pump component 109 of motor and pump assembly 105. Pump 109 is coupled in driven relationship with a motor 113 as represented by dashed line 117. Right nozzle 82 and associated ball valve 98 are coupled via hose or line 102 to the output of the pump component 110 of motor and pump assembly 106. In this regard, pump 110 is connected in driven relationship with motor 114 as represented by dashed line 118. The input to pump 108 is coupled in fluid transfer relationship with the snow-ice control liquid source as represented schematically at fluid lines 120 and 121 extending to the output port 122 of liquid source tank 46. In similar fashion, the input of pump 109 is coupled in fluid flow transfer relationship with the liquid source at tank 46 as represented schematically at fluid lines 124, 120 and 121. Finally, the input to pump 110 is coupled in fluid flow transfer relationship with the liquid source at tank 46 as represented schematically at lines 120 and 121. The pressure outputs of pumps 108–110 additionally are coupled to respective relief valves 124–126 via lines 127–129. Valves 124–126 are mounted upon and in fluid transfer relationship with tank 46. Preferably brine pumps 108–110 are of a fixed displacement gear pump variety wherein their volumetric output can be accurately established. Control for this purpose is developed with respect to the drive output speed of motors 112 and 114, the forward velocity of vehicle 10, and the effective diameter of the outputs of nozzles 80–82. The term "effective" is employed with the term "diameter" inasmuch as the nozzles may exhibit a noncircular profile, and a determination of cross-sectional area will be seen to be called for. However, a circular profile is preferred.

Figure 5:
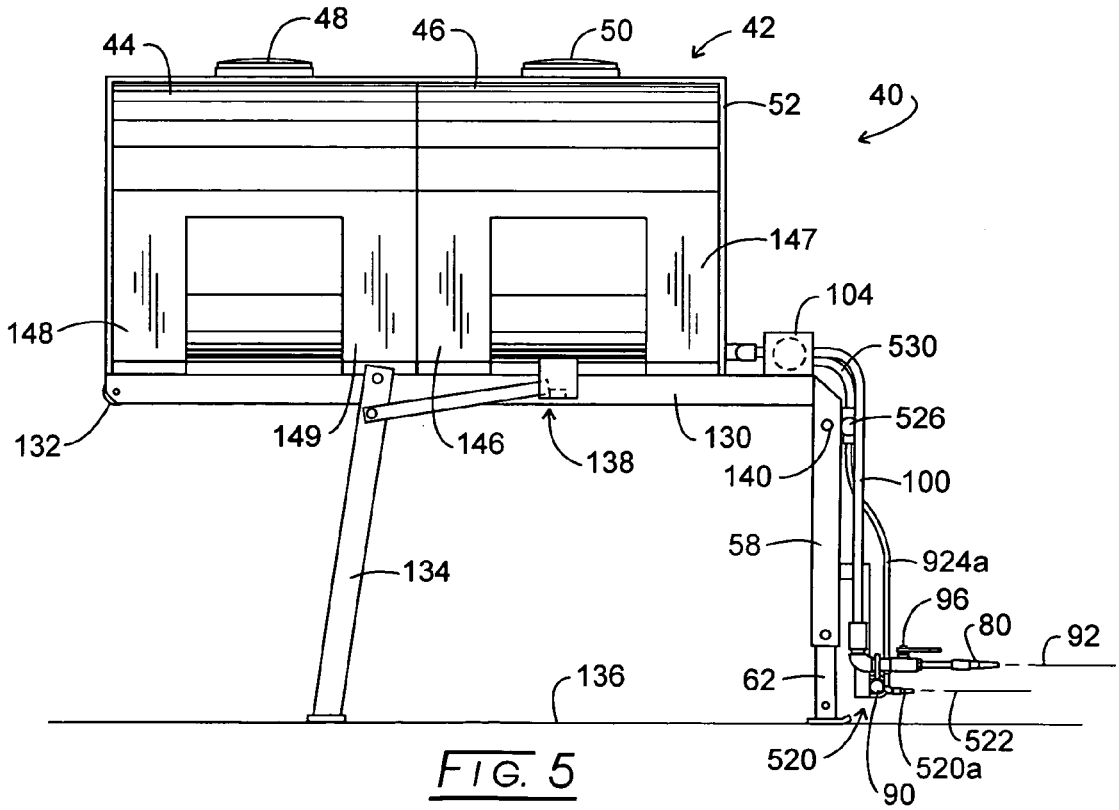
FIG. 5 is a left elevational view of the frame mounted brine deposition assembly shown in FIGS. 2 and 3 but with the frame components in an orientation prior to being mounted upon a truck-type vehicle.

Returning to FIGS. 2 and 3 and looking additionally to FIG. 5, the frame supporting apparatus 40 is seen to be configured with two or more forward longitudinal support beams, one of which is shown at 130 in FIG. 5, the rearward end of which is welded to vertically oriented standard 58. The forward tip of beam 130 supports a roller 132 as does the longitudinal support beam arranged in parallel with beam 130. In this regard, one such longitudinal support beam and associated roller is similarly rigidly connected with standard 60. The frame further is configured with pivotally coupled right and left forward legs, a left forward leg being shown at 134 in FIG. 5 extending from a pivotal connection with support beam 130 to ground surface 136. The left and right forward legs as at 134 are retained in position by a lockable and releasable bracket assembly as represented generally at 138. Legs as at 134 as well as the standards 58 and 60 and associated extended foot components 62 and 64 position the longitudinal support beams as at 130 at about bed height 70 shown in FIG. 3. Accordingly, to load the assemblage 40 on a dump truck form of vehicle as at 10, the truck merely backs into the assemblage 40, whereupon rollers engage the dump bed surface following which the support legs as at 134 are pivoted rearwardly. Upon full entry onto the dump bed, foot components 62 and 64 are retracted as seen in FIG. 3. The entire frame assembly is retained upon the dump bed by the engagement of horizontally outwardly extending bars 140 and 141 with respective tailgate hooks 142 and 143. FIG. 5 further reveals the structuring of brine tanks 44 and 46. In this regard, tank 46 is configured with integrally formed oppositely disposed support portions 146 and 147 having flat bottom surfaces. In similar fashion, brine tank 44 is configured with identical support portions 148 and 149. Such support portions 146–149 further function to control liquid slosh phenomena.

The motors 112–114 which drive respective pumps 108–110 are of a fixed displacement hydraulic type, for example, exhibiting a characteristic of three cubic inches of hydraulic fluid per revolution. The motors normally are employed for more conventional snow-ice control activities of the vehicle 10, three of them being illustrated for the instant description. In this regard, the motors will normally drive a dump bed mounted granular salt distributing auger which, in turn, feeds either a spinner or right or left impeller implemented salt ejector mechanism which propels a relatively thin band of brine wetted salt granules upon a snow/ice covered roadway at a rearwardly directed velocity which corresponds with the forward speed of the vehicle thus minimizing granular salt scatter and permitting the development of a higher concentration brine over the snow-ice-pavement bond. In addition to these hydraulic motor activities, the hydraulic system functions to maneuver plows and to operate the dump bed hoist. These processor controlled deposition systems are described, for example, in the above U.S. Pat. Nos. 5,318,226; 5,988,535; and 6,446,879. The hydraulic form of digital binary control over the hydraulic motors is described in the above-noted patent No. RE. 33,835. The third motor of the presently described system typically is employed to drive a salt wetting brine pump.

Figure 6:
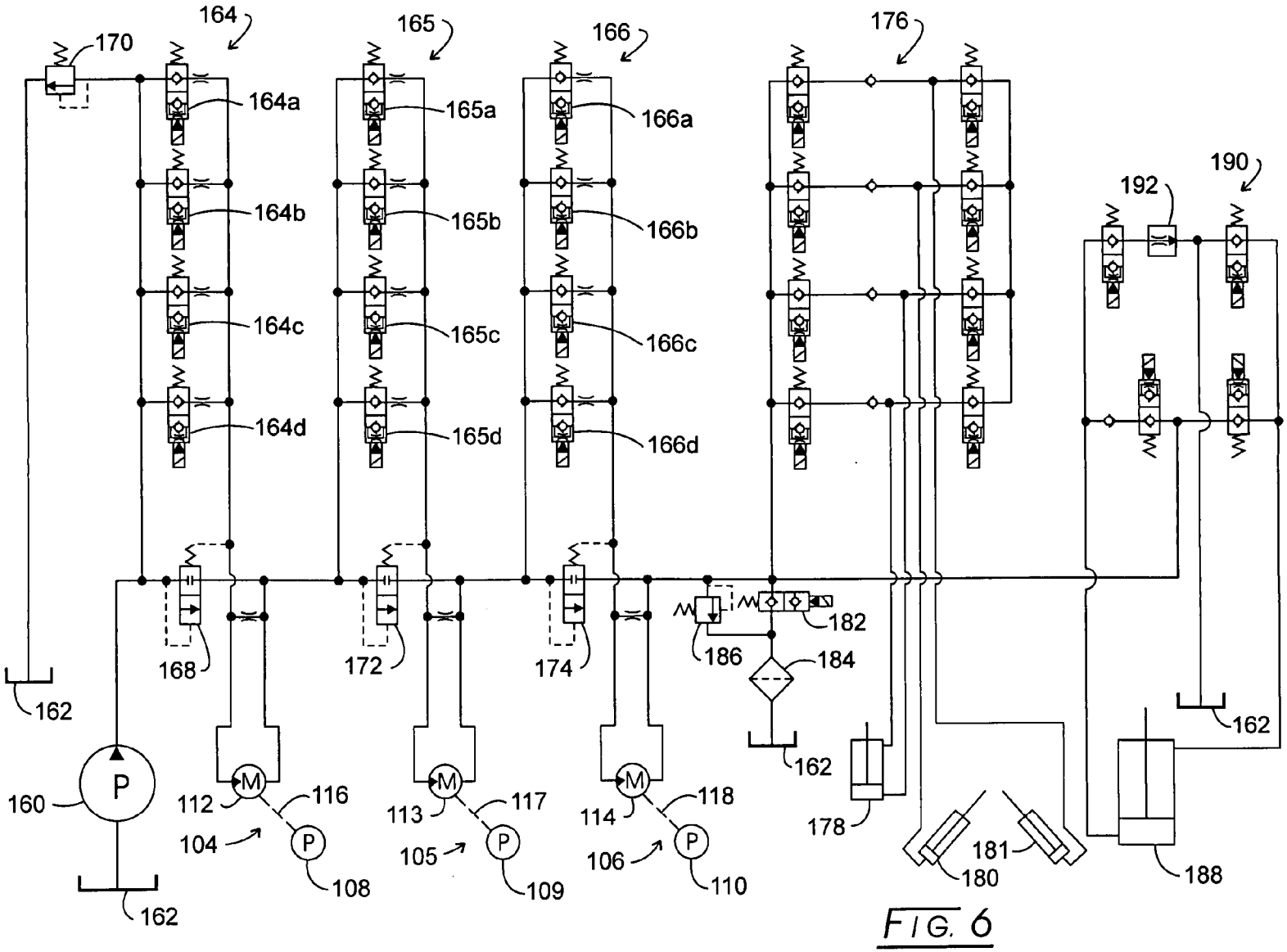
FIG. 6 is a schematic hydraulic diagram showing the components employed with the truck of FIG. 2.

Referring to FIG. 6, the hydraulic system employed with the vehicle 10 and apparatus 40 as it is implemented for roadway pretreatment with brine liquids or the like is provided. In the figure, the motor and pump combinations 104–106 reappear with the same identifying numeration. The hydraulic system performs in conjunction with a truck engine driven hydraulic pump 160 and a hydraulic reservoir represented by the symbol 162. Note that the speed of motor 112 is controlled by a binary digital array 164 of four solenoid actuated valves which, in turn, are controlled by a vehicle speed responsive electronic controller system. Within the array, valve 164*a* establishes a 1.0 GPM hydraulic flow; valve 164*b* establishes a 2.0 GPM hydraulic flow; valve 164*c* establishes a 4.0 GPM hydraulic flow and valve 164*d* establishes a 8 GPM hydraulic flow. Array 164 functions when in a salt distribution mode as an auger speed control. A compensator is represented at 168 functioning to provide a constant speed or pressure drop and a main relief valve is shown at 170.

Digital binary solenoid actuated valve array 165 functions to control the speed at motor 113 and is seen to be comprised of valves 165*a*–165*d*, which perform in the same manner as the valves at array 164. The motor normally functions to drive a spinner. A compensator is shown at 172 which functions with the same general purposes as compensator 168.

Binary digital solenoid actuated valve array 166 functions to control speed of motor 114 and performs in the same general manner as the valves of array 164. In this regard, array 166 is configured with valves 166*a*–166*d*. The motor normally functions to drive a brine pump. A compensator 174 functions with the same general purpose as compensators 168 and 172. The forward plow of the vehicle is controlled by the array of solenoid actuated valves represented generally at 176. A hydraulic cylinder providing plow lift and lowering is represented schematically at 178, while the front plow angle control hydraulic cylinders are represented schematically at 180 and 181. A bypass valve is shown at 182. Valve 182 is normally open to assure that no hydraulic pressure is associated with the bed or plow unless needed. A return filter is shown at 184 and a relief valve is represented at 186. A bed hoist hydraulic cylinder is symbolically represented at 188. Cylinder 188 is controlled by the valve of a valve array represented generally at 190. The valves of array 190 perform in conjunction with a compensator 192 which functions to assure constant bed velocity in a down direction notwithstanding the amount of load it is carrying.

The hydraulic system of FIG. 6 is controlled from a console mounted within cab 12. The user interfacing front of such a control box as well as an auxiliary box is illustrated in connection with FIG. 7. Referring to that figure, the face of control box or console and associated auxiliary box are represented in general respectively at 200 and 202. The labels provided at face 200 are associated with the plow and dump bed hoist as well as those components employed for granular salt disposition and the brine wetting of such salt. On the other hand, the labeling at face 202 is concerned with enabling or activating the three speed controlled motors and snow-ice control liquid associated pumps. Located upwardly on face 200 is an LCD display 204 providing for readouts to the vehicle operator depending upon the positioning of a mode switch 206. Switch 206 is moveable to any of eight positions from 1 to 8 providing, respectively: speed of vehicle 10 in miles per hour; the deposition of material rate in pounds per mile; date and time; distance measured in feet from a stop position; distance measured from a stop position in miles; a data logging option; temperature of hydraulic fluid; and pressure of hydraulic fluid. Main power is controlled from a switch 208 and the movement of the dump bed up and down normally or slowly is controlled from switch 210. Correspondingly, a fast down movement of the dump bed can be controlled from a switch 212. Control over the main or front plow as at 18 in terms of elevation is provided at switch 214 and a right-left directional control is provided from switch 216. Correspondingly, control over a wing plow in terms of elevation is provided from switch 218 and a right-left directional control over such plow is provided from switch 220. Elevational control of a scraper plow mounted beneath frame 16 is provided from switch 222, while a corresponding left-right orientation of the scraper plow is controlled from switch 224. Auger blast actuation is developed at switch 226. This function provides for essentially maximum rotational speed of the augers in supplying an impeller with granular salt. The selection of either a fully automatic salt dispensing function or a manual salt dispensing function is elected by actuation of toggle switch 228. Additionally, the switch 228 has an orientation for turning off the auger distribution function. When this switch is in an automatic orientation, the amount of snow-ice salt material is controlled automatically with respect to the forward speed of vehicle 10 and predetermined inserted data as to, for example, poundage of such salt material per mile. When in a manual operational mode, the rate of material output is set by the operator. In electing these amounts, for example, an auger switch 230 may be positioned at any of 16 detent orientations for selecting the quantity of material deposited. When the system is in an automatic mode as elected at switch 228, switch 230 selects the material application in pounds per mile, adjusting the hydraulic control system automatically with respect to vehicle speed. The control of the speed of salt dispensing impellers is provided manually by the 16 position switch 232. When switch 228 is in an automatic mode and impeller switch 232 is in its $16^{th}$ position, the speed of the ejector motor values to drive pumps is automatically elected with respect to vehicle speed. Control over a third motor functioning to drive a brine pump is provided from switch 234. That control also may automatically establish motor and thus pump output with respect to vehicle speed. Two additional switches are provided at the console face plate 200 and these switches are key-actuated for security purposes. The first such switch as at 236 provides a manual lock-out function wherein the operator is not able to operate the system on a manual basis and must operate it on an automatic basis. Correspondingly, key switch 238 moves the control system into a calibrate/maintenance mode. Control consoles incorporating the features described in conjunction with face 200 are marketed by H. Y. O., Inc., of Columbus, Ohio. Face 202 of the auxiliary box contains three enabling or activation switches which function only in conjunction with the reconfiguration of the software of the main console to perform in conjunction with apparatus 40 for dispensing snow-ice control liquids such as sodium chloride brine. Actuation of left side switch 240 will selectively enable the motor pump combination 104 and the associated left nozzle 80. Selective actuation of switch 242 will enable or activate pump and motor combination 105 in association with intermediate nozzle 81. Selective actuation of right side switch 244 will permit the enablement or activation of motor and pump assembly 106 and associated nozzle 82. The software associated with the control system is reconfigured for snow-ice liquid pretreatment control or the like once apparatus 40 has been installed by setting switches 230, 232 and 234 to a zero position; setting the mode switch 206 to position number 2; setting switch 228 to an off position and pressing and holding down the blast switch 226 for a momentary interval. With this arrangement, the control system must be intentionally set up for liquid distribution and when the truck ignition subsequently is shut off, the system software reverts to its standard granular salt distribution configuration. Wiring associated with switches 240, 242 and 244 extends to otherwise unused connections associated with the wing and scrapper switch inputs. Those connections will be read by a control system microprocessor as a switch input.

Figure 8:
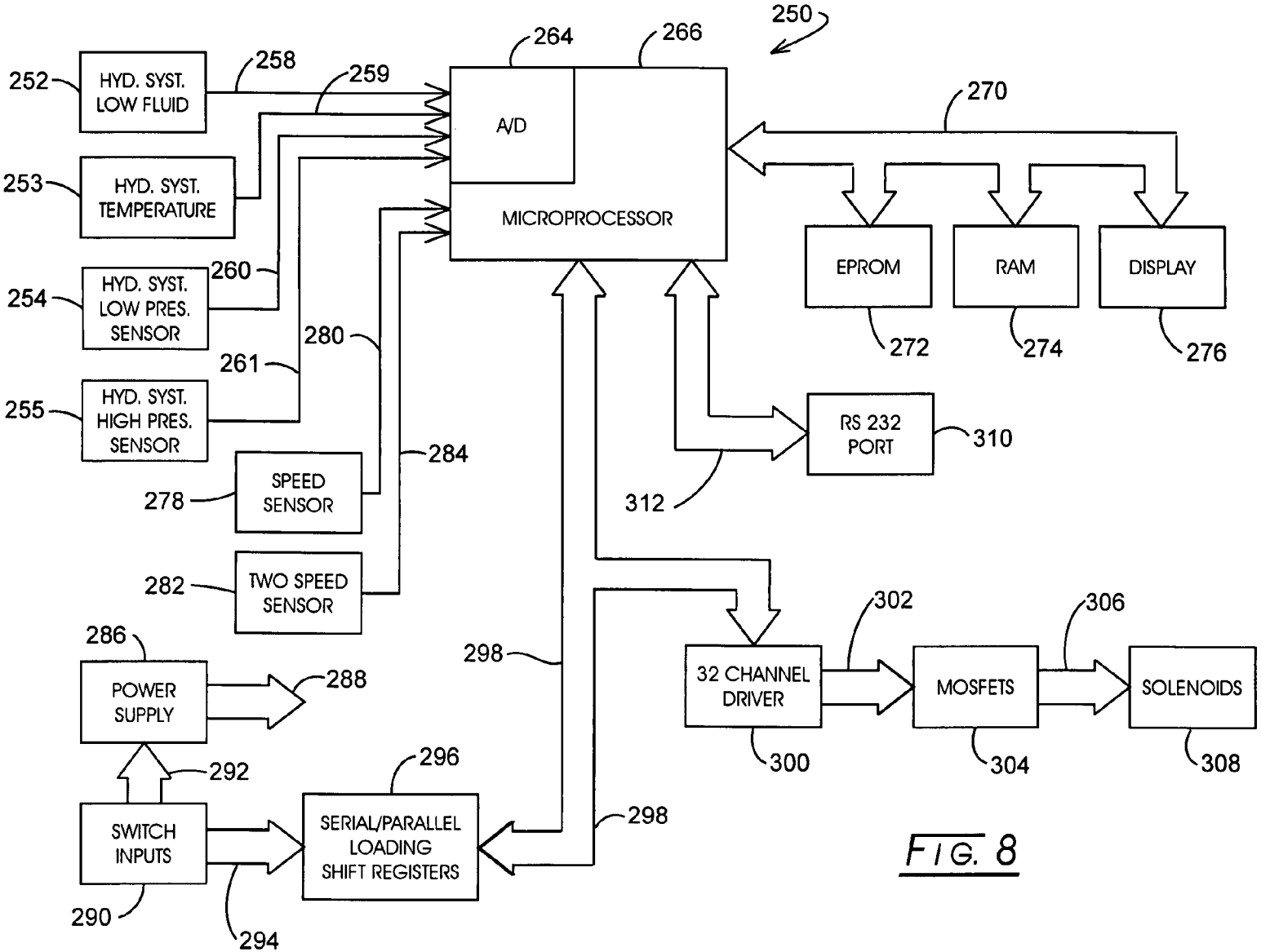
FIG. 8 is a block schematic diagram of a control circuit which may be employed with the invention.

Referring to FIG. 8, a block diagrammatic representation of a microprocessor driven control function for vehicle 10 and it associated snow-ice control features is identified generally at 253. The control function operates in conjunction with six sensor functions. In this regard, a hydraulic system low fluid sensor is provided as represented at block 252. A hydraulic system temperature sensor function is provided as represented at block 253. Hydraulic system low-pressure sensor function is provided as represented at block 254, and a hydraulic system high-pressure sensor is provided as represented at block 255. The functions represented at blocks 252–255 provide inputs as represented at respective lines 258–261 to the analog-to-digital function represented at sub-block 264 of a microprocessor represented at block 266. Microprocessor 266 may be provided as a type 68HC11 marketed by Motorola Corporation. Device 266 is a high-density complimentary metal-oxide semiconductor with an eight bit MCU with on-chip peripheral capabilities. These peripheral functions include an eight-channel analog-to-digital (A/D) converter as noted above. An asynchronous serial communication interface is provided and a separate synchronous serial peripheral interface is included. Its main sixteen-bit, free-running timer system has three input capture lines, five-compare lines, and a realtime interrupt function. An eight-bit pulse accumulator sub-system can count external events or measure external periods. Device 266 performs in conjunction with memory (EPROM) as represented at bi-directional bus 270 and block 272. Communication also is seen to be provided via bus 270 with random access memory (RAM) as represented at 274 and function 274 may be provided, for example, as a DS 1644 non-volatile time-keeping RAM marketed by Dallas Semi-Conductor Corporation. The LCD display 204 is represented at block 276. This function may be provided by a type DV-16100 S1FBLY assembly which consists of an LCD display, a CMOS driver and a CMOS LSI controller marketed by Display International of Oviedo, Fla. Digital sensor inputs to the microprocessor function 266 are provided from a speed sensor represented at block 278 and line 280. In general, the speed sensor will output 40,000 pulses per mile of vehicle travel which equates to 7.5 pulses per foot. A two speed sensor digital input is supplied to microprocessor 266 as represented at block 282 and line 284.

The circuit power supply is represented at block 286. This power supply, providing two levels of power, distributes such levels where required as represented at arrow 288. Supply 286 is activated from the switch inputs as discussed in connection with FIG. 7 and represented in the instant figure at block 290 and arrow 292. These various console and auxiliary console or control box switch inputs as represented at block 290 also are directed, as represented at arrow 294 to serial-parallel loading shift registers as represented at block 296. As represented by bus 298, communication with the function at block 296 is provided with the microprocessor function represented at block 266. Bus 298 also is seen directed to a thirty-two channel driver function represented at block 300. Function 300 may be implemented with a thirty-two channel serial-to-parallel converter with high voltage push-pull outputs marketed as a type HV9308 by Supertex, Inc. The output of the driver function represented at block 300 is directed, as represented by arrow 302, to an array of metal-oxide semiconductor field effect transistors (MOSFETS) as represented at block 304. These devices may be provided as auto-protected MOSFETS type VNP10N07F1 marketed by SGS-Thomson Microelectronics, Inc. The outputs from the MOSFET array represented at block 304 are directed as represented by arrow 306 to solenoid actuators as represented at block 308. An RS232 port is provided within the control function 250 as represented at block 310 and arrow 312 communicating with microprocessor function 266.

Figure 9:
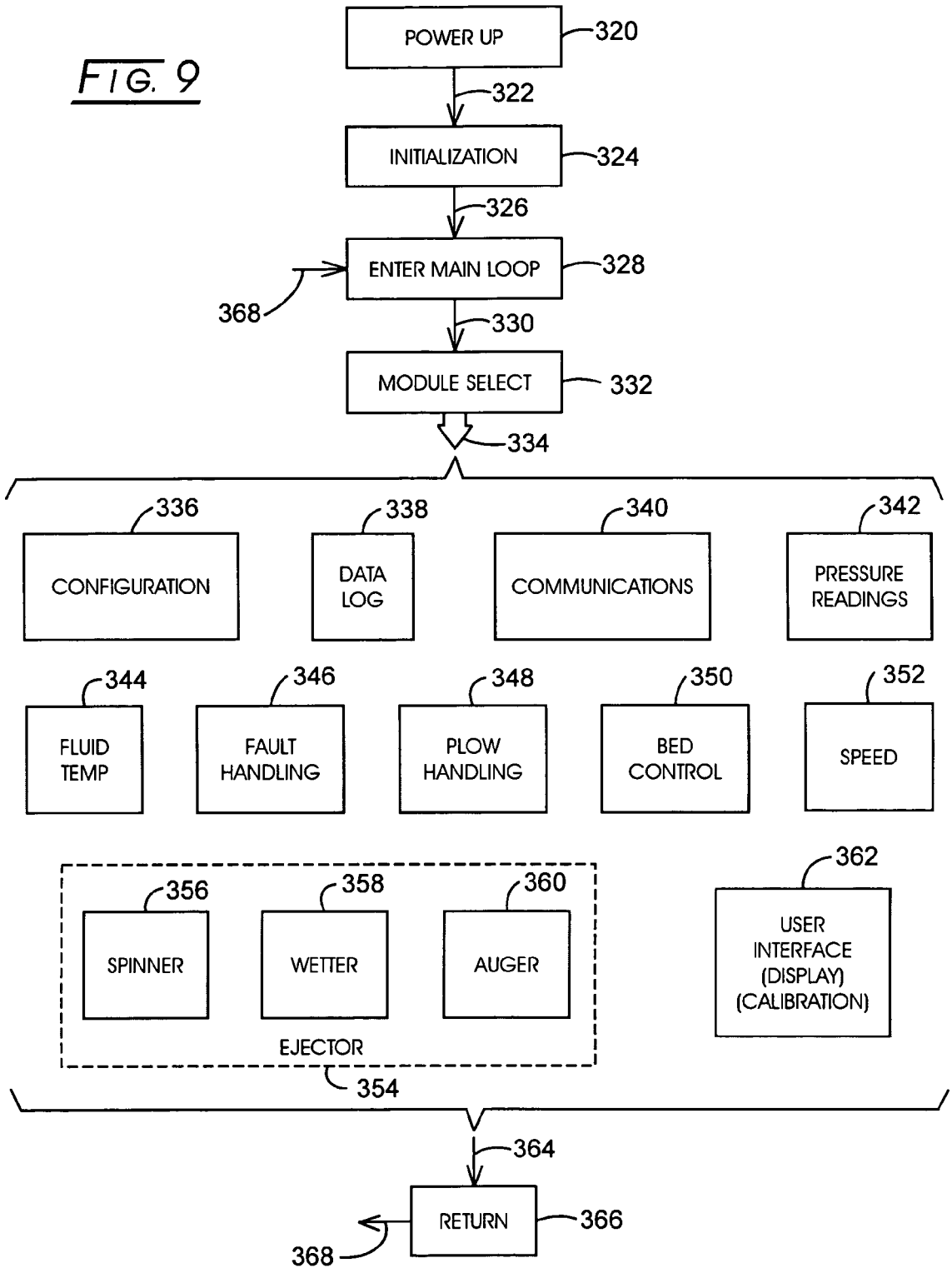
FIG. 9 is a block diagram illustrating the general control program employed with the invention.

Referring to FIG. 9, a block diagram of the program with which the microprocessor function represented at block 266 performs as set forth. As represented at block 320, the program carries out a conventional power-up procedure upon the system being turned on. Then, as represented by line 322 and block 324, conventional initialization procedures are carried out. Upon completion of the initialization procedures, as represented by line 326 and block 328, the program enters into a main loop. In effect, the main loop performs in the sense of a commutator, calling for a sequence of tasks or modules. Certain of those tasks are idle tasks which are activated when no other components of the program are active. Additionally, the system is somewhat event driven to the extent that it monitors random inputs as from switches and the like. Thus, as represented at line 330 and block 332, the main loop functions to select modules in a sequence and the module identification selection is represented by arrow 334. An initial module is represented at block 336 which provides a configuration function, particularly with respect to the entering of new data into memory when configurations change.

Block 338 represents a data log module wherein data for a given trip of the vehicle 10 is recorded. For example, data is collected each five seconds with respect to such functions as turning on augers, auger speed and the like or, alternately, for the instant application motor/pump speeds. Such information then may be read out as a record at the end of any given trip. A module providing for communication as represented at block 340 handles the function of the RS 232 port. Block 342 represents a pressure reading module which carries out a sampling of hydraulic pressure at a relatively fast rate and provides a filtering in software to improve values from that. The fluid temperature module represented at block 344 periodically reads hydraulic fluid temperature and carries out software filtering of the data. Block 346 represents a fault-handling module which looks for various fault conditions in the system and provides a two-second fault message at the LCD display 204. This module also can carry out shut down procedures under certain conditions. Block 348 describes a plow-handling module which functions to carry out control of the front and wing plows which may be employed with vehicle 10. A bed control module is represented at block 350 which handles the control of the dump bed of the truck 10. Block 352 looks to a module which develops distance and speed data. Dashed boundary 354 represents a composite module identified as an ejector module. In this regard, the module tracks data concerning an impeller function performance represented at block 356 and identified as a "spinner" function which for liquid deposition purposes is concerned with spinner and pump function 104. Additionally, the module 354 looks to the performance of the brine delivery pumping function as represented at block 358. For the instant application, this function is represented by the motor and pump combination 106 and, finally, module 354 considers the speed of augers as driven from auger motors as is represented at block 360. For the instant application, the auger motor now is motor and pump combination 104. Block 362 represents the user interface module which responds to a variety of user interface activities such as switching. It includes a sub-module for providing display outputs and for responding to calibration inputs.

When the modules have been evaluated in the main loop, then as represented at line 364 and block 366, the program returns and as represented at line 368 which reappears in conjunction with block 328, the main loop again is entered.

Figure 10:
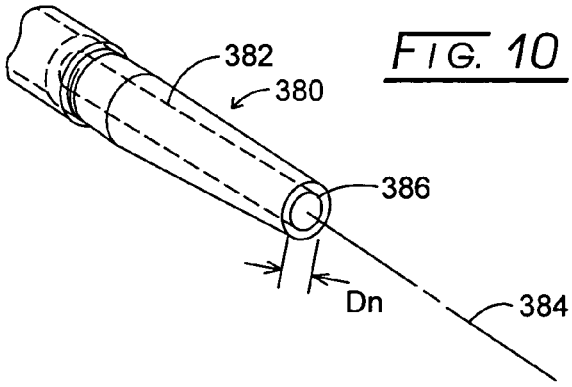
FIG. 10 is a perspective view of a streamer nozzle which may be employed with the invention.

The expression of snow-ice control liquid or brine from the streamer nozzles 80–82 is carried out in a controlled volumetric fashion commensurate with the forward speed of the vehicle 10. The liquid expression also is at a velocity having a rearwardly directed vector parallel with the roadway pavement surface which corresponds with the vehicle forward speed to the extent that there is no relative velocity or zero relative velocity between the expressed volume of liquid and the surface of the pavement upon which it will fall under the influence of gravity. That decent will be from an elevation quite close to the pavement surface in avoidance of the air turbulence created by the movement of the vehicle itself. Not only does this low location avoid truck occasioned air turbulence but also takes advantage of any surface effect evoked from the pavement at which position air velocity approaches zero. The control developed is derived in conjunction with a target brine or liquid application in terms of, for instance, gallons per roadway or lane mile. A typical pretreatment application, for example, for the left nozzle will be thirty gallons per lane mile. The control evoked is one which considers target application; vehicle speed and the effective diameter, or actual diameter for a round aperture, nozzle, $D_n$. Looking momentarily to FIG. 10, an exemplary streamer nozzle is represented generally at 380. Formed, for example, of stainless steel, the nozzle 380 will have a centrally disposed bore 382 symmetrically disposed about a nozzle axis 384 and extending to a nozzle outlet 386 exhibiting a diameter, $D_n$.

Figure 11:
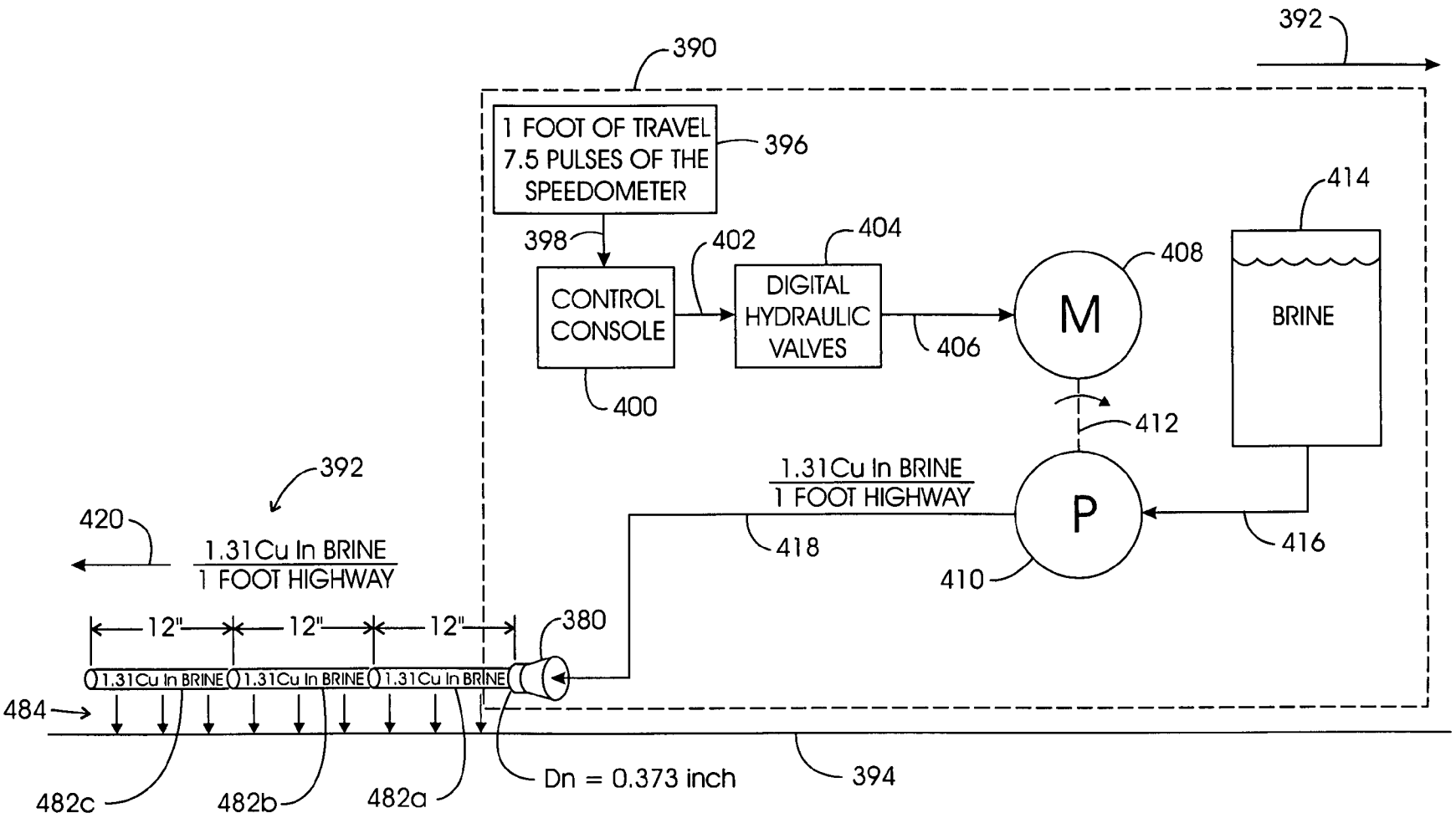
FIG. 11 is a schematic diagram illustrating the approach for deriving a targeted volumetric brine deposition for a given streamer nozzle.

Now referring to FIG. 11, the technique for determining the streamer nozzle outlet diameter, $D_n$ is schematically portrayed. In the figure, vehicle mounted components are represented within dashed boundary 390. That vehicle is assumed to have a forward speed of, for instance, 55 miles per hour as represented by velocity vector arrow 392. The vehicle will be moving over the roadway surface or pavement surface represented at line 394. Assuming, as noted above, that the truck speedometer or transmission outputs 40,000 pulses per mile of travel, such an output will translate to 7.5 pulses per foot of travel as represented by the speed input travel block 396. That speed data will be directed to the control console mounted in the vehicle cab as represented at 398 and block 400. A target volumetric brine application of 30 gallons per mile per nozzle translates into the deposition of 6,930 cubic inches of brine per lane mile per nozzle which, in turn, represents 1.31 cubic inches of brine per foot of roadway. Accordingly, control console 400, as represented at arrow 402 will control an appropriate digital array of solenoid actuated valves as described at 164–166 and represented at block 404. Such a valve array, as represented at arrow 406, will supply a volume of hydraulic fluid to a fixed displacement hydraulic motor represented at circle 408 which, in turn, will drive a brine pump 410 as represented at dashed line 412. The input of pump 410 is coupled in fluid flow transfer communication with brine supply tank 414 as represented at arrow 416. Pump 410 preferably will be a fixed displacement gear pump and will deliver a volume of six cubic inches per revolution at its output represented at arrow 418. That output will represent 1.31 cubic inches of brine for each foot of roadway. Note that arrow 418 extends to the input of streamer nozzle 380 having an outlet diameter, $D_n$. The size of that diameter may be computed in accordance with the follow expression:

$$\sqrt[D_n]{\frac{(4)\times(\text{Volume of Brine})}{(\pi)\times(\text{Length})}} \tag{1}$$

Substituting 1.31 for the volume of brine and 12 inches for the length of one foot results in a diameter, $D_n$ of 0.373 inches. Thus, liquid brine will be expressed through nozzle 380 at 55 miles per hour relative to the 55 mile per hour vehicle speed as represented by horizontal vector arrow 420 to in effect, create cylindrical volumes of liquid for successive 12 inches of roadway each having a volume of 1.31 cubic inches of brine as represented by the sequence of cylindrical volumes 482*a*–482*c*. As represented by arrow array 484 these cylindrical volumes of brine liquid will fall under the influence of gravity to the pavement surface 394. As indicated earlier herein, a very slight downward cant of the nozzle axis 384 is found to be beneficial. That downward cant is with respect to surface 394 and will fall within a range of from about 0° to about 5°.

Figure 12:
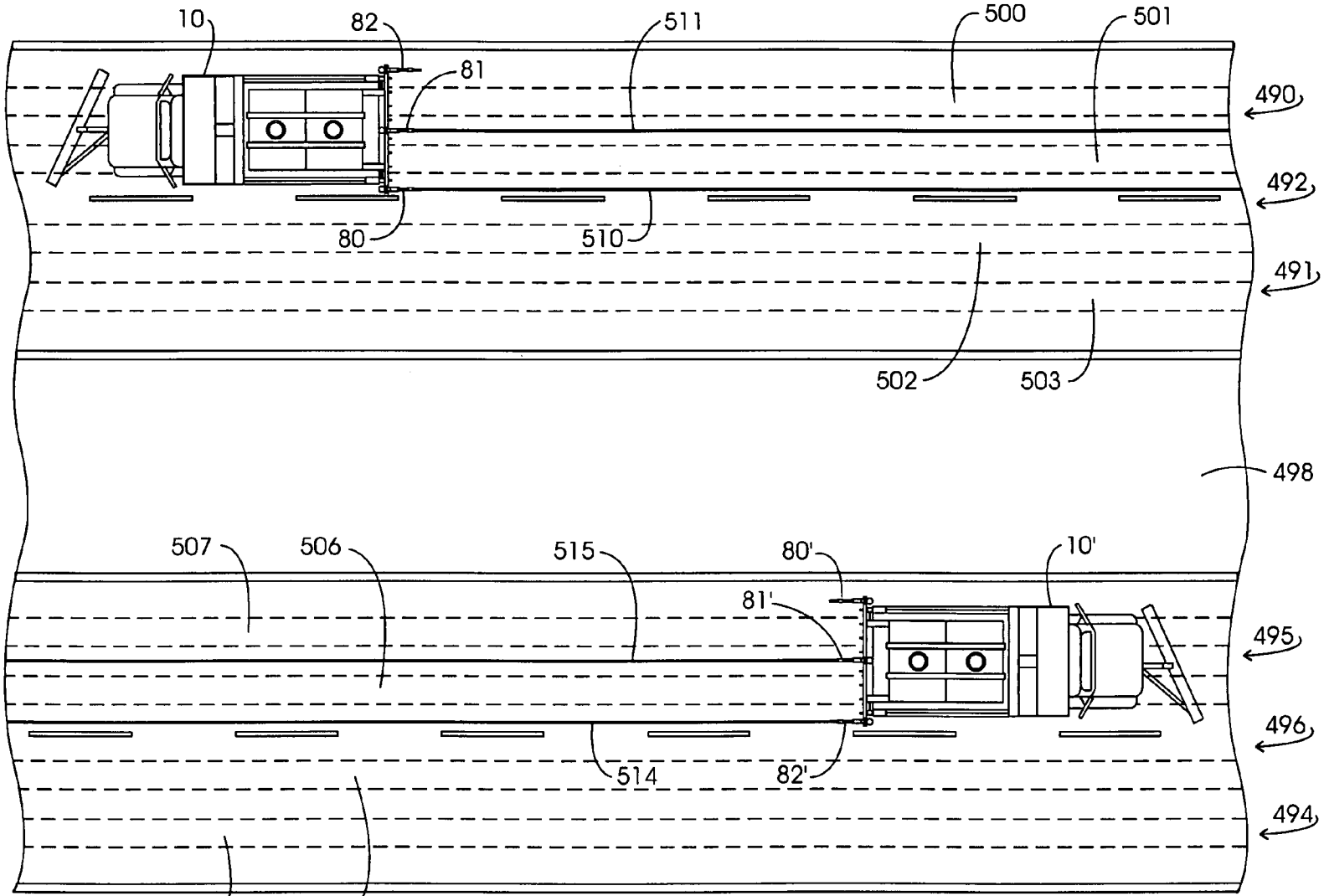
FIG. 12 is a plan view of a primary roadway showing a method of liquid brine distribution according to the invention.

Returning to FIG. 3 and looking additionally to FIG. 12 the method involved in utilizing nozzles 80–82 for pretreatment purposes is disclosed. In FIG. 12 a primary roadway is illustrated having dual lanes represented generally at 490 and 491 separated by lane-defining strips represented generally at 492 and intended for traffic movement in a right-to-left sense in connection with the figure. Two additional lanes 494 and 495 separated by lane-defining strips represented generally at 496 provides for traffic movement in the sense of left-to-right in the figure. Lanes 491 and 495 are separated by a median 498. With this arrangement in a typical roadway design, the lane-defining strips will represent a crown or highest elevation of the roadways to permit drainage to flow toward opposite sides of the roadway. Vehicular traffic utilizing lane 490 in general will pass within spaced apart wheel tracks represented in dashed line fashion at 500 and 501. Similarly, passing vehicular traffic in lane 491 will move within wheel tracks generally illustrated by dashed boundaries 502 and 503. In similar fashion, vehicles utilizing lane 494 will move within wheel tracks represented generally at 504 and 505, while vehicles utilizing the passing lane 495 will create wheel tracks represented generally by the dashed boundaries 506 and 507.

Figure 7:
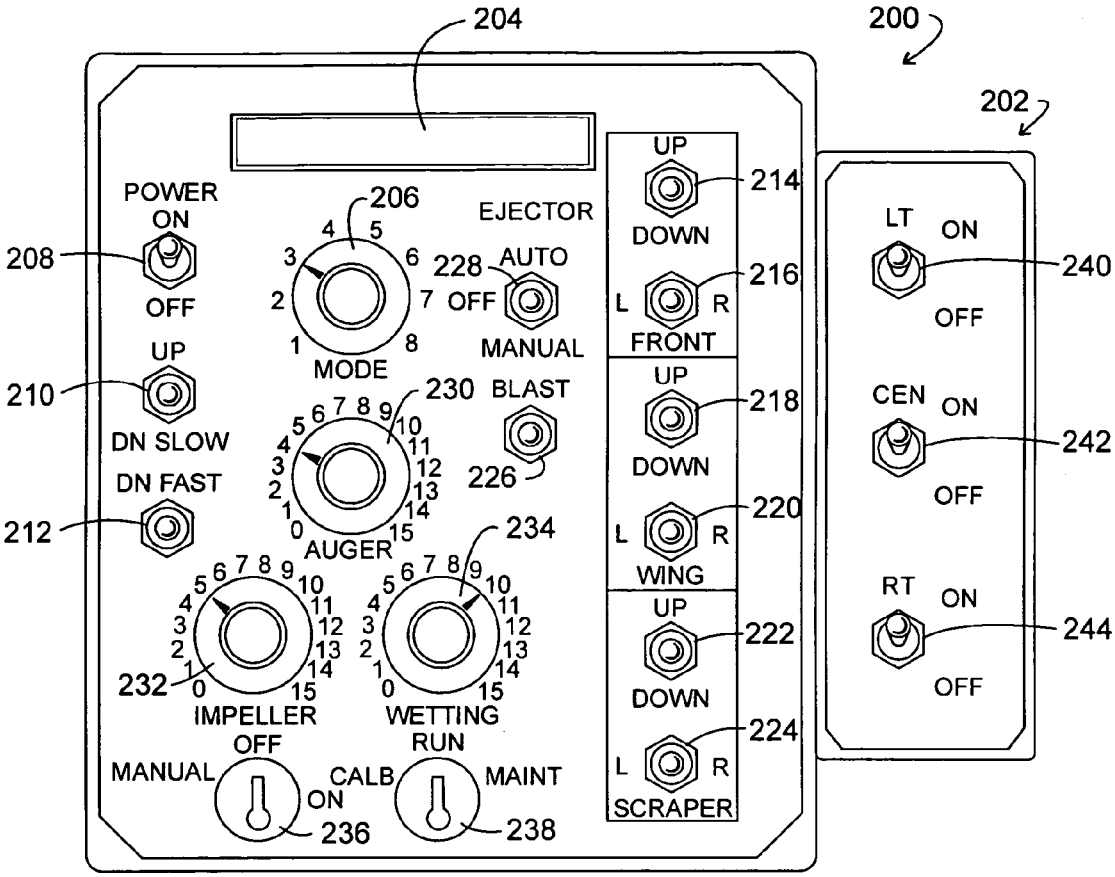
FIG. 7 is a front view of the panels of a control console and an auxiliary control box which may be employed with the invention.

Truck 10 is seen pre-treating lane 490 with brine from left nozzle 80 and intermediate nozzle 81. A resultant brine deposition is represented respectively at 510 and 511. Brine deposition 510 will be out of the wheel tracks 501 and thus not disturbed by coincident traffic. The brine deposition will dry quickly on the dry pavement. In similar fashion, intermediate nozzle 81 will deposit brine strip 511 between the wheel tracks 500 and 501. Note that right nozzle 82 is not activated. Accordingly, for the run shown in connection with truck 10, switches 240 and 242 are in an on position and switch 244 is in an off position (FIG. 7). When a weather event does occur, brine depositions 510 and 511 will be wetted and will migrate downgrade toward and into the regions defined by wheel tracks 501 and 500 to generally prevent the formation of a snow-ice-pavement bond.

Truck 10' is illustrated pre-treating roadway lane 495. For this roadway configuration, right nozzle 82' is activated to provide a brine deposition represented at 514. Intermediate nozzle 81' also is activated to provide a brine deposition represented at 515. Left nozzle 80' is not activated. With this arrangement, the brine strips 514 and 515 are deposited in pre-treatment fashion on dry pavement such that they are not disturbed by vehicles creating the vehicle or wheel tracks 506 and 507. Upon the occurrence of a subsequent precipitation event the brine depositions will return to solution and migrate, brine deposition 514 migrating into vehicle wheel track 506 and brine deposition 515 migrating into wheel track 507 to prevent the creation of a snow-ice-pavement bond. As is apparent, the operator of truck 10' will turn on switches 242 and 244 and turn off switch 240.

Some authorities consider it to be advantageous to deposit liquid brine across an entire lane at a given target volume per unit of roadway distance. This alternate approach may be used for treating frosted roadways or black ice which is considered by some investigators to have insufficient liquid content to reconstitute a dried brine. The same volumetric control features of apparatus 40 may be employed for this purpose.

Returning to FIGS. 2 and 3, nozzle support crossrod 90 is seen to support an array shown in general at 520 of eight alternate streamer nozzles. These eight streamer nozzles are identified individually at 520*a*–520*h* and are seen to be regularly spaced apart along the vehicle track width 72. FIGS. 2 and 5 reveal the nozzle axis 522 for nozzle 520*a*. As before, this nozzle axis is substantially parallel with the surface of pavement 24 as well as with the direction of forward movement or velocity of truck 10. This orientation is provided for all eight nozzles within the array 520. However, the nozzle axes may be canted downwardly a very slight amount from a parallel relationship with the roadway pavement surface, for instance, from about 0° to about 5°. However, the principal rearwardly directed velocity vector parallel to the roadway surface for the liquid material streaming from the nozzles will correspond with the instantaneous forward speed of vehicle 10 to achieve a zero relative velocity between the emerging streams of liquid and the pavement surface. Configured of brass, these nozzles are formed in the fashion described in connection with FIG. 10, each having a nozzle input, a nozzle axis and a nozzle effective diameter. The input of each of the nozzles 520*a*–520*h* is coupled to a respective nozzle conduit or hose 524*a*–524*h*. Conduits 524*a*–524*h* extend, in turn to the liquid output ports of an elongate tubular distribution manifold 526 mounted to the nozzle support of apparatus 40 at standards 58 and 60. Manifold 526 may be configured with a polymeric material such as polyvinylchloride. The manifold 526 is supplied snow-ice control liquid from one or more of the motor and pump assemblies 104–106. For the instant embodiment, the output of motor-pump component 104 is seen coupled via election ball valve 528, metering conduit 530 and "T" 532 to manifold 526. Additionally, the output of motor-pump component 106 is coupled via election ball valve 534, metering conduit 536 and "T" 538 to distribution manifold 526.

Looking to FIG. 4, where the operator wishes to configure apparatus 40 for full lane width brine deposition, election ball valves 528 and 534 are opened and ball valves 96–98 are closed. For the instant arrangement, left and right switches 240 and 244 are turned on and the center switch 242 is turned off. Assuming that a total target volume of brine distribution to be expressed by nozzles 520*a*–520*h* is sixty gallons per mile, then the nozzle array 520 will be called upon to express 2.625 cubic inches of liquid per foot of travel over pavement. Utilizing the computational approach described in connection with FIG. 11, each of the eight nozzles 520*a*–520*h* will be called upon to express 0.328 cubic inches of liquid for each 12 inches of pavement, for example, as described in conjunction with computational cylinders 482*a*–482*c*. Utilizing expression (1) above, the diameter, $D_n$ as described in connection with FIG. 10 theoretically will be 0.186 inches. In practice, for simplification of nozzle manufacture, a diameter of 0.188 inches has been employed.

As discussed above, a significant cause of snow-ice control liquid loss through splash, overspray and the like has been in consequence of the turbulence of air caused by the movement of the depositing vehicle 10. That turbulence generally is created rearwardly of the vehicle as it is driven forwardly. Returning momentarily to FIG. 2, the nozzle components may be mounted forwardly of vehicle 10 as an alternate arrangement. At that location represented generally at 542, truck induced air turbulence will not have been created and additionally, a wind baffle may be positioned forwardly of the streamer nozzles. In this regard, such a baffle may be implemented as the forward plow 18 which not only serves as an air baffle but also protects the streamer nozzles. At location 542, the components earlier described as located rearwardly of truck 10 are identified with the same numeration but in primed fashion. At location 542, the nozzle components and cross beam 90' are mounted upon the support structure of plow assembly 18.

Figure 13:
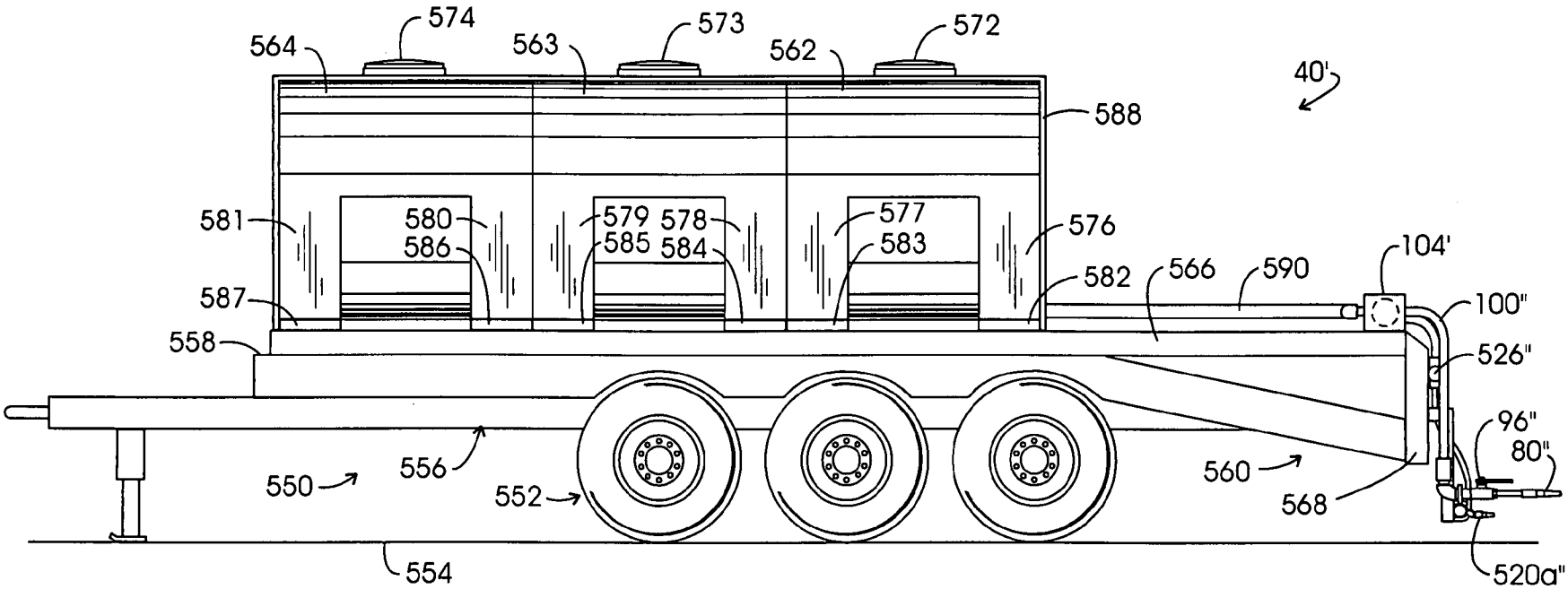
FIG. 13 is a left side elevational view of a towable trailer supporting apparatus according to the invention.

Liquid brine deposition systems as at 40 additionally may be mounted upon a trailer form of vehicle. Looking to FIG. 13, such an arrangement is depicted in general at 40'. With this arrangement, a trailer represented generally at 550 having a wheel assembly represented generally at 552 engaging a pavement surface 554 is provided. Trailer 550 is configured with a frame represented generally at 556 having a support portion 558 which is formed with a downwardly slanting region represented generally at 560. Aperture whereas 40' is seen incorporating three interconnected polymeric tanks 562–564 which are mounted upon a galvanized frame including spaced apart longitudinal beams, one of which is shown at 566. Similar to the arrangement of FIG. 5, beam 566 is coupled to a vertical galvanized standard 568. Tanks 562–564 are configured with respective manways 572–574 and their support portions 576–581 are seen engaged for support with respective frame cross members 582–587. As before, the tanks 562–564 are retained against those cross members by galvanized straps, one of which is shown at 588. Tanks 562–564 are interconnected at their bottom regions in fluid flow transfer communication and a common output conduit as seen at 590 is directed to three motor-pump components, one of which is shown at 104'. Components of the brine distribution nozzle assembly and the like are shown in the figure with the common numeration shown in FIGS. 3–5 but in double primed fashion.

Since certain changes may be made in the above-described method and apparatus without departing from the scope of the invention herein involved, it is intended that all matter contained in the description thereof or shown in the accompanying drawings shall be interpreted as illustrative and not in a limiting sense.

The invention claimed is:

1. The method of treating the surface of a roadway by depositing snow/ice treatment liquid onto the surface of the roadway as a liquid quantity per unit of roadway length from a vehicle moving at a given forward velocity and direction having leftward and rightward pavement engaging wheels generally exhibiting wheel tracks spaced apart along a vehicle width and a support portion; comprising the steps of:

(a) supporting a tank contained source of said snow/ice treatment liquid at said vehicle support portion;

(b) providing at least one streamer nozzle having an input, a nozzle axis and an output with a nozzle effective diameter;

(c) mounting said at least one streamer nozzle generally about the region established by said vehicle width in an orientation wherein said nozzle output is rearwardly directed said nozzle axis extends substantially parallel with said roadway surface and vehicle forward direction and is located in spaced adjacency with said roadway surface;

(d) providing a fluid transfer assembly including a drivable pump assembly and extending in fluid transfer communication between said tank contained source of said snow/ice treatment liquid and said streamer nozzle input;

(e) monitoring the forward velocity of said vehicle; and (f) driving said pump assembly in correspondence with said monitored forward velocity and said nozzle effective diameter at a pump speed effective to express said snow/ice treatment liquid from said nozzle with a fluid flow velocity vector substantially parallel with said roadway surface and corresponding with said vehicle forward velocity.

2. The method of claim 1 in which:

said step (f) drives said pump assembly at a rate expressing from said at least one streamer nozzle a volume of said snow/ice treatment liquid corresponding with said liquid quantity per unit of roadway length.

3. The method of claim 2 in which:

said step (b) provides said at least one streamer nozzle as having a nozzle effective diameter corresponding with said pump assembly rate of expressing a volume of said snow/ice treatment liquid.

4. The method of claim 2 in which:

said step (d) provides said fluid transfer assembly pump assembly as having at least one fixed displacement pump.

5. The method of claim 1 in which:

said step (c) mounts a said streamer nozzle spaced leftwardly outwardly from the wheel track of a said leftward wheel.

6. The method of claim 5 in which:

said step (c) mounts a said streamer nozzle generally between the wheel tracks of said leftward and rightward wheels.

7. The method of claim 5 in which:

said step (d) provides said fluid transfer assembly as having a discrete pump coupled in fluid transfer relationship with the streamer nozzle input of said streamer nozzle spaced leftwardly outwardly from the wheel track of said leftward wheel.

8. The method of claim 6 in which:

said step (d) provides said fluid transfer assembly as having a discrete pump coupled in fluid transfer relationship with the streamer nozzle input of said streamer nozzle located between the wheel tracks of said leftward and rightward wheels.

9. The method of claim 1 in which:

said step (c) mounts a said streamer nozzle spaced rightwardly outwardly from the wheel track of said rightward wheel.

10. The method of claim 9 in which:

said step (d) provides said fluid transfer assembly as having a discrete said pump coupled in fluid transfer relationship with the streamer nozzle input of said streamer nozzle spaced rightwardly outwardly from the wheel track of said rightward wheel.

11. The method of claim 9 in which:

said step (c) mounts a said streamer nozzle generally between the wheel tracks of said leftward and rightward wheels.

12. The method of claim 11 in which:

said step (d) provides said fluid transfer assembly as having a discrete pump coupled in fluid transfer relationship with the streamer nozzle input of said streamer nozzle located between the wheel tracks of said leftward and rightward wheels.

13. The method of claim 1 in which:

said step (c) mounts said streamer nozzle to be located in spaced adjacency with said roadway surface to generally encounter a surface effect avoiding vehicle induced air turbulence.

14. The method of claim 1 in which:

said step (c) mounts said streamer nozzle to be located from about two inches to about six inches from said roadway surface.

15. The method of claim 1 in which:

said step (c) mounts said streamer nozzle forwardly of said leftward and rightward pavement engaging wheels.

16. The method of claim 1 in which:

said step (c) mounts said streamer nozzle in an orientation wherein said nozzle axis is canted downwardly from a plane parallel with said pavement surface an angle from 0° to about 5°.

17. The method of claim 1 in which:

said vehicle is a trailer; and said step (a) supports said tank contained source of said snow/ice treatment liquid at a support portion of said trailer.

18. Snow/ice control apparatus for treating the surface of a roadway by depositing snow/ice treatment liquid thereon from a vehicle moving at a given forward velocity and direction, having leftward and rightward pavement engaging wheels generally exhibiting respective left and right wheel tracks spaced apart along a vehicle track width and having a support portion, comprising:

a tank assembly mountable upon said vehicle support portion and configured to retain a quantity of said snow/ice treatment liquid;

a nozzle assembly mountable upon said vehicle including a nozzle support extending in spaced adjacency with said roadway surface and one or more streamer nozzles, including a left streamer nozzle, each having an input, a nozzle axis and a nozzle effective diameter, said left streamer nozzle being supported by said nozzle support laterally from said left wheel track in closely spaced adjacency with said roadway surface in a rearwardly directed orientation wherein the nozzle axis thereof extends substantially parallel with said roadway surface and vehicle forward direction;

a motor assembly supportable upon said vehicle and controllable when activated to provide one or more drive outputs;

a first pump supportable upon said vehicle, coupled in driven relationship with a said drive output, having a first pump input coupled in fluid flow transfer relationship with said tank assembly and a first pump output coupled in fluid flow transfer relationship with the input of said left streamer nozzle; and a control assembly responsive to said vehicle velocity to control said motor assembly, when activated, in correspondence with a target volume of said snow/ice treatment liquid per unit length of roadway, the output of said first pump and the effective diameter of said left streamer nozzle, to effect expression of said snow/ice treatment liquid from said left streamer nozzle at a velocity having a vector generally parallel with said roadway surface substantially corresponding with said vehicle velocity and at said target volume of said snow/ice treatment liquid per unit length of roadway.

19. The apparatus of claim 18 in which:

said nozzle assembly support locates said left streamer nozzle in spaced adjacency with said roadway surface to generally encounter an airflow surface effect.

20. The apparatus of claim 18 in which said first pump is a fixed displacement pump.

21. The apparatus of claim 18 in which:

said nozzle assembly nozzle support locates said left streamer nozzle leftwardly outwardly from said left wheel track.

22. The apparatus of claim 18 in which:

said nozzle assembly further comprises a right streamer nozzle, said right streamer nozzle being supported by said nozzle support laterally from said right wheel track in spaced adjacency with said roadway surface in a rearwardly directed orientation wherein the nozzle axis thereof extends substantially parallel with said roadway surface and said vehicle forward direction;

further comprising a second pump supportable upon said vehicle, coupled in driven relationship with said drive output, having a second pump input coupled in fluid flow transfer relationship with said tank assembly and a second pump output coupled in fluid flow transfer relationship with the input of said right streamer nozzle; and said control assembly is responsive to said vehicle velocity to control said motor assembly, when activated, in correspondence with a right nozzle target volume of said snow/ice treatment liquid per unit length of roadway, the output of said second pump and the effective diameter of said right streamer nozzle at a velocity having a vector parallel with said roadway surface substantially corresponding with said vehicle velocity and at said right nozzle target volume of snow/ice treatment liquid unit length of roadway.

23. The apparatus of claim 22 in which said second pump is a fixed displacement pump.

24. The apparatus of claim 22 in which:

said nozzle assembly further comprises an intermediate streamer nozzle, said intermediate streamer nozzle being supported by said nozzle support between said right wheel track and said left wheel track in spaced adjacency with said roadway surface in an orientation wherein the nozzle axis thereof extends substantially parallel with said roadway surface and said vehicle forward direction;

further comprising a third pump supportable upon said vehicle, coupled in driven relationship with said drive output, having a third pump input coupled in fluid flow transfer relationship with said tank assembly and a third pump output coupled in fluid flow transfer relationship with the input of said intermediate streamer nozzle; and said control assembly is responsive to said vehicle velocity to control said motor assembly, when activated, in correspondence with an intermediate nozzle target volume of said snow/ice treatment liquid per unit length of roadway, the output of said third pump and the effective diameter of said intermediate streamer nozzle at a velocity having a vector parallel with said roadway surface substantially corresponding with said vehicle velocity and at said intermediate nozzle target volume of snow/ice treatment liquid unit length of roadway.

25. The apparatus of claim 24 in which said third pump is a fixed displacement pump.

26. The apparatus of claim 22 in which:

said nozzle assembly nozzle support locates said right streamer nozzle in spaced adjacency with said roadway surface to generally encounter an airflow surface effect;

27. The apparatus of claim 22 in which:

said nozzle assembly nozzle support locates said right streamer nozzle rightwardly outwardly from said right wheel track.

28. The apparatus of claim 22 in which said motor assembly comprises:

a first motor having a drive output coupled in driving relationship with said first pump; and a second motor having a drive output coupled in driving relationship with said second pump.

29. The apparatus of claim 24 in which said motor assembly comprises:

a first motor having a drive output coupled in driving relationship with said first pump;

a second motor having a drive output coupled in driving relationship with said second pump; and a third motor having a drive output coupled in driving relationship with said third pump.

30. The apparatus of claim 18 further comprising:

a frame assembly configured to support said tank assembly, said nozzle assembly, said motor assembly and said first pump, and further configured for removable positioning upon said vehicle support portion.

31. The apparatus of claim 30 in which:

said vehicle is a truck wherein said support portion is a truck bed located a bed height above said roadway;

said frame assembly is configured having right and left rigid standards adjacent said nozzle support for locating said frame a mounting elevation above ground level corresponding with said bed height, and further having right and left forward legs of length generally corresponding with said bed height pivotally coupled with a forward portion of said frame assembly, having a vertical orientation for supporting said frame assembly at about said bed height and rearwardly pivotable to an extent effective to maneuver said frame assembly onto said truck bed.

32. The apparatus of claim 30 in which:

said vehicle is a trailer wherein said support portion is a trailer bed; and said frame assembly is configured for mounting upon said trailer bed.

33. The apparatus of claim 18 in which:

said vehicle is a truck wherein said leftward and rightward roadway engaging wheels include forward leftward and rightward roadway engaging wheels and rearward leftward and rightward roadway engaging wheels; and said nozzle assembly is supported from said truck generally forwardly of said forward leftward and rightward roadway engaging wheels.

34. The apparatus of claim 33 in which:

said truck is configured with a forward depending snow/ice control plow; and said nozzle assembly is supported rearwardly of said plow.

35. The apparatus of claim 24 further comprising:

a snow/ice treatment liquid distribution manifold, supported from said nozzle support generally above said right, left and intermediate streamer nozzles, having one or more liquid inputs, and an array of a predetermined number of liquid output ports;

an array of a predetermined number of rearwardly directed alternate streamer nozzles supported in generally regularly spaced fashion by said nozzle support and generally extending between said left and right streamer nozzles, each said alternate streamer nozzle having an input, a nozzle axis and a nozzle effective diameter and being located in spaced adjacency with said roadway surface in an orientation wherein the nozzle axis thereof extends substantially parallel with said roadway surface and vehicle forward direction;

an array of a predetermined number of nozzle conduits extending in fluid flow communication between said manifold array of liquid output ports and the inputs of said array of said predetermined number of rearwardly directed alternate streamer nozzles;

one or more metering conduits extending in fluid flow communication between the output of one or more said first, second or third pumps and said one or more liquid distribution manifold liquid inputs;

the number of outputs of said one or more first, second and third pumps and the effective diameter of said array of said predetermined number of rearwardly directed alternate streamer nozzles being selected in correspondence with a target volume of said snow/ice treatment liquid per unit length of roadway.

36. The apparatus of claim 35 further comprising:

an election valve assembly selectively actuable to effect fluid flow between said first, second and third pumps and respective left, right and intermediate streamer nozzles or between one or more of said first, second and third pumps and said delivery manifold.

37. The apparatus of claim 35 in which:

said array of said predetermined number of rearwardly directed alternate streamer nozzles are supported in spaced adjacency with said roadway surface to generally encounter an airflow surface effect.

38. Snow/ice control apparatus for treating the surface of a roadway by depositing snow/ice treatment liquid thereon from a vehicle moving at a given forward velocity and direction, having leftward and rightward roadway engaging wheels generally exhibiting respective left and right wheel tracks spaced apart a vehicle track width, and having a support portion, comprising:

a tank assembly mountable upon said vehicle support portion and configured to retain a quantity of said snow/ice treatment liquid;

a nozzle assembly mountable upon said vehicle including a nozzle support extending in spaced adjacency with said roadway and extending rearwardly of said wheels along said vehicle track width and a plurality of spaced apart rearwardly directed streamer nozzles of given number each having an input, a nozzle axis and a nozzle effective diameter each said streamer nozzle being supported by said nozzle support in closely spaced adjacency with said roadway surface in an orientation wherein the nozzle axis thereof extends substantially parallel with said roadway surface and vehicle forward direction;

a motor assembly supportable upon said vehicle and controllable to provide one or more drive outputs;

a pump assembly having a first pump supportable upon said vehicle, coupled in driven relationship with a said drive output, having a first pump input coupled in fluid flow transfer relationship with said tank assembly and a first pump output;

a liquid distribution manifold supportable upon said vehicle, having a first liquid input coupled in fluid flow transfer communication with said first pump output and a plurality of output ports of said given number;

a distribution conduit assembly configured to couple each said given number of output ports with a corresponding respective said streamer nozzle input; and a control assembly responsive to said vehicle velocity to control said motor assembly in correspondence with a target volume of said snow/ice treatment liquid per unit length of roadway, the output of said first pump and the sum of the effective diameters of said given number of said plurality of spaced apart rearwardly directed streamer nozzles to effect expression of said snow/ice treatment liquid from said plurality of spaced apart rearwardly directed streamer nozzles at a velocity having a vector parallel with said roadway surface substantially corresponding with said vehicle velocity and with a combined volume of snow/ice treatment liquid per unit length of roadway corresponding with said target volume said snow/ice treatment liquid per unit length of roadway.

39. The apparatus of claim 38 in which:

said first pump is a fixed displacement pump.

40. The apparatus of claim 38 in which:

said nozzle assembly nozzle support locates said plurality of spaced apart rearwardly directed streamer nozzles in spaced adjacency with said roadway surface to generally encounter an airflow surface effect.

41. The apparatus of claim 38 in which:

said plurality of spaced apart rearwardly directed streamer nozzles are supported by said nozzle support in regularly spaced apart relationship.

42. The apparatus of claim 38 in which:

said liquid distribution manifold is supported by said nozzle support at a location generally above said plurality of spaced apart rearwardly directed streamer nozzles.

43. The apparatus of claim 38 in which:

said plurality of spaced apart rearwardly directed streamer nozzles are supported by said nozzle support in an orientation wherein said nozzle axes thereof are canted downwardly toward said roadway surface at an angle from about 0° to about 5°.

44. The apparatus of claim 38 in which:

said pump assembly includes a second pump supportable upon said vehicle, coupled in driven relationship with a said drive output, having a second pump input coupled in fluid flow transfer relationship with said tank assembly and a second pump output;

said liquid distribution manifold has a second liquid input coupled in fluid flow transfer relationship with said second pump output; and said control assembly is responsive to said vehicle velocity to control said motor assembly in correspondence with said target volume of said snow/ice treatment liquid per unit length of roadway, the sum of the outputs of said first and second pumps and the sum of the effective diameters of said given number of streamer nozzles to effect expression of said snow/ice treatment liquid from said plurality of streamer nozzles at a velocity having a vector parallel with said roadway surface substantially corresponding with said vehicle velocity and with a combined volume of said snow/ice treatment liquid per unit length of roadway corresponding with said target volume said snow/ice treatment liquid per unit length of roadway.

* * * * *